US009758963B2

(12) United States Patent
Kawai et al.

(10) Patent No.: US 9,758,963 B2
(45) Date of Patent: Sep. 12, 2017

(54) BEARING WALL AND WALL SURFACE MEMBER FOR BEARING WALL

(71) Applicants: NIPPON STEEL & SUMITOMO METAL CORPORATION, Tokyo (JP); NS HI-PARTS CORPORATION, Kani-shi, Gifu (JP)

(72) Inventors: Yoshimichi Kawai, Tokyo (JP); Shigeaki Tohnai, Tokyo (JP); Shinichiro Hashimoto, Kani (JP); Kazunori Fujihashi, Kani (JP); Atsushi Sato, Kasugai (JP); Tetsuro Ono, Nagoya (JP)

(73) Assignees: NIPPON STEEL & SUMITOMO METAL CORPORATION, Tokyo (JP); NS HI-PARTS CORPORATION, Kani-Shi (JP)

( * ) Notice: Subject to any disclaimer, the term of this patent is extended or adjusted under 35 U.S.C. 154(b) by 0 days.

(21) Appl. No.: 14/917,550

(22) PCT Filed: Sep. 9, 2014

(86) PCT No.: PCT/JP2014/073836
§ 371 (c)(1),
(2) Date: Mar. 8, 2016

(87) PCT Pub. No.: WO2015/034099
PCT Pub. Date: Mar. 12, 2015

(65) Prior Publication Data

US 2016/0222650 A1 Aug. 4, 2016

(30) Foreign Application Priority Data

Sep. 9, 2013 (JP) ..... 2013-186511

(51) Int. Cl.
*E04H 9/02* (2006.01)
*E04B 1/98* (2006.01)
(Continued)

(52) U.S. Cl.
CPC ..... *E04B 1/98* (2013.01); *E04B 1/24* (2013.01); *E04B 2/56* (2013.01); *E04B 2/60* (2013.01);
(Continued)

(58) Field of Classification Search
CPC ..... E04C 2003/0473; E04C 2003/0434; E04C 2003/0421; E04C 2001/2696; E04B 2001/2496; E04H 9/02
(Continued)

(56) References Cited

U.S. PATENT DOCUMENTS 1,994,716 A * 3/1935 Klemperer ..... B64C 1/065 52/634
4,894,898 A * 1/1990 Walker ..... B21D 47/01 29/416
(Continued)

FOREIGN PATENT DOCUMENTS

JP 57-35051 Y2 8/1982
JP 2002-81156 A 3/2002
JP 3737368 B2 1/2006

OTHER PUBLICATIONS

International Search Report for PCT/JP2014/073836 mailed on Nov. 25, 2014.
(Continued)

*Primary Examiner* — Rodney Mintz
*Assistant Examiner* — Daniel Kenny
(74) *Attorney, Agent, or Firm* — Birch, Stewart, Kolasch & Birch, LLP

(57) ABSTRACT

A bearing wall includes a pair of vertical members that are joined to upper and lower horizontal members of a building
(Continued)

so as to be spaced apart in a horizontal direction; and a wall surface member that includes a first joint portions joined to one of the vertical members, that includes a second joint portions joined to another of the vertical members, and that includes circular-shaped opening portions that are spaced apart in an up-down direction between the pair of vertical members so as to be disposed in a single column. A separation distance between a center of one opening portion and a center of an opening portion that is adjacent to the one opening portion in the up-down direction is shorter than a horizontal separation distance between the first joint portions and the second joint portions.

5 Claims, 38 Drawing Sheets

(51) Int. Cl.
*E04B 2/56* (2006.01)
*E04B 2/60* (2006.01)
*E04C 3/32* (2006.01)
*E04B 1/24* (2006.01)

(52) U.S. Cl.
CPC ..... *E04C 3/32* (2013.01); *E04H 9/024* (2013.01); *E04B 2001/2481* (2013.01)

(58) Field of Classification Search
USPC ... 52/741.18, 741.17, 651.01, 651.07, 173.1, 52/40, 848, 223.5
See application file for complete search history.

(56) References Cited

U.S. PATENT DOCUMENTS 5,527,625 A * 6/1996 Bodnar ..... E04C 3/065 428/595
6,012,256 A * 1/2000 Aschheim ..... E04B 1/24 52/167.1
D438,987 S * 3/2001 Ryan ..... D25/102
8,327,592 B2 * 12/2012 Lafferty, III ..... E04B 1/26 52/220.2
8,640,412 B2 * 2/2014 Kato ..... E04B 2/706 52/302.3
D757,521 S * 5/2016 Rosner ..... D8/354
2002/0038533 A1 * 4/2002 Potter ..... E04B 1/26 52/634
2002/0162284 A1 * 11/2002 Karalic ..... E04C 2/386 52/167.1
2005/0144892 A1 * 7/2005 Strickland ..... B21D 47/01 52/837
2007/0175149 A1 * 8/2007 Bodnar ..... B21D 19/00 52/481.1

OTHER PUBLICATIONS

Office Action issued in corresponding Japanese Patent Application No. 2014-560165 mailed on Apr. 14, 2015.
Written Opinion of the International Searching Authority for PCT/JP2014/073836 (PCT/ISA/237) mailed on Nov. 25, 2014.

* cited by examiner

FIG.6A

INVESTIGATIONS INTO RADII OF CIRCULAR ARC PORTIONS OF RIBS (UNDER CONDITIONS OF: HEIGHT DIMENSION OF RIBS BEING 15 mm, AND SPACING BETWEEN HOLE PORTIONS BEING 75 mm) ON WALL SURFACE MEMBERS 3 EMPLOYING 500 × 300 STEEL SHEET MEMBERS

| CURVE RADIUS | 0 | 5 | 10 | 15 | 20 |
|---|---|---|---|---|---|
| MAXIMUM VON MISES STRESS | 293MPa<br>A1<br>256MPa | 269MPa<br>A2<br>264MPa | 251MPa<br>A3<br>280MPa | 242MPa<br>A4<br>292MPa | 231MPa<br>A5<br>300MPa |

FIG.7A

INVESTIGATIONS INTO RADII OF CIRCULAR ARC PORTIONS OF RIBS (UNDER CONDITIONS OF: HEIGHT DIMENSION OF RIBS BEING 15 mm, AND SPACING BETWEEN HOLE PORTIONS BEING 75 mm) ON WALL SURFACE MEMBERS 3 EMPLOYING 700 × 433 STEEL SHEET MEMBERS

| CURVE RADIUS | 0 | 5 | 10 | 15 | 20 |
|---|---|---|---|---|---|
| MAXIMUM VON MISES STRESS | 356.7MPa<br>340.3MPa A'1 | 363.9MPa<br>357.9MPa A'2 | 355.4MPa<br>384.5MPa A'3 | 352.0MPa<br>410.3MPa A'4 | 350.6MPa<br>434.7MPa A'5 |

INVESTIGATIONS INTO HEIGHT DIMENSION OF RIBS (UNDER CONDITIONS OF:
RADIUS OF CIRCULAR ARC PORTION OF RIBS BEING 10 mm, AND
SPACING BETWEEN HOLE PORTIONS BEING 75 mm)
ON WALL SURFACE MEMBERS 3 EMPLOYING 500 × 300 STEEL SHEET MEMBERS

FIG.9A

INVESTIGATIONS INTO HEIGHT DIMENSION OF RIBS (UNDER CONDITIONS OF: RADIUS OF CIRCULAR ARC PORTION OF RIBS BEING 10 mm, AND SPACING BETWEEN HOLE PORTIONS BEING 75 mm) ON WALL SURFACE MEMBERS 3 EMPLOYING 700 × 433 STEEL SHEET MEMBERS

| HEIGHT | 0 | 5 | 10 | 15 | 20 |
|---|---|---|---|---|---|
| MAXIMUM VON MISES STRESS | 394.8MPa<br>330.1MPa B'1 | 424.8MPa<br>397.8MPa B'2 | 374.6MPa<br>384.7MPa B'3 | 355.4MPa<br>384.5MPa B'4 | 349.7MPa<br>381.8MPa B'5 |

INVESTIGATIONS INTO SPACING BETWEEN HOLE PORTIONS (UNDER CONDITIONS OF: RADIUS OF CIRCULAR ARC PORTION OF RIBS BEING 10 mm, AND HEIGHT DIMENSION OF RIBS BEING 15 mm) ON WALL SURFACE MEMBERS 3 EMPLOYING 500 × 300 STEEL SHEET MEMBERS

FIG.11A

INVESTIGATIONS INTO SPACING BETWEEN HOLE PORTIONS (UNDER CONDITIONS OF: RADIUS OF CIRCULAR ARC PORTION OF RIBS BEING 10 mm, AND HEIGHT DIMENSION OF RIBS BEING 15 mm) ON WALL SURFACE MEMBERS 3 EMPLOYING 700 × 433 STEEL SHEET MEMBERS

| SPACING BETWEEN HOLE PORTIONS | 30 | 75 | 90 | 121.6 | 200 |
|---|---|---|---|---|---|
| MAXIMUM VON MISES STRESS | 384.4MPa<br>C'1<br>487.7MPa | 355.4MPa<br>C'2<br>384.5MPa | 346.8MPa<br>C'3<br>358.8MPa | 331.1MPa<br>C'4<br>313.6MPa | 308.3MPa<br>C'5<br>245.4MPa |

INVESTIGATIONS INTO SHEET THICKNESS (UNDER CONDITIONS OF: RADIUS OF CIRCULAR ARC PORTION OF RIBS BEING 10 mm, HEIGHT DIMENSION OF RIBS BEING 15 mm, AND SPACING BETWEEN HOLE PORTIONS BEING 75 mm) ON WALL SURFACE MEMBERS 3 EMPLOYING 500 × 300 STEEL SHEET MEMBERS

INVESTIGATIONS INTO SHEET THICKNESS (UNDER CONDITIONS OF: RADIUS OF CIRCULAR ARC PORTION OF RIBS BEING 10 mm, HEIGHT DIMENSION OF RIBS BEING 15 mm, AND SPACING BETWEEN HOLE PORTIONS BEING 75 mm) ON WALL SURFACE MEMBERS 3 EMPLOYING 700 × 433 STEEL SHEET MEMBERS

INVESTIGATIONS INTO DIAMETER OF HOLE PORTIONS (UNDER CONDITIONS OF: RADIUS OF CIRCULAR ARC PORTION OF RIBS BEING 10 mm, HEIGHT DIMENSION OF RIBS BEING 15 mm, AND SPACING BETWEEN HOLE PORTIONS BEING 75 mm) ON WALL SURFACE MEMBERS 3 EMPLOYING 500 × 300 STEEL SHEET MEMBERS

INVESTIGATIONS INTO NUMBERS OF COLUMNS (UNDER CONDITIONS OF: RADIUS OF CIRCULAR ARC PORTION OF RIBS BEING 10 mm, HEIGHT DIMENSION OF RIBS BEING 15 mm, AND SPACING BETWEEN HOLE PORTIONS BEING 75 mm) ON WALL SURFACE MEMBERS 3 EMPLOYING 700 × 433 STEEL SHEET MEMBERS

| NUMBERS OF COLUMNS | 1 | 2 |
|---|---|---|
| MAXIMUM VON MISES STRESS | 198.0MPa  G1 375.0MPa | 182.8MPa  G2 257.0MPa |

(UNDER CONDITIONS OF: RADIUS OF CIRCULAR ARC PORTION OF RIBS BEING 10 mm, HEIGHT DIMENSION OF RIBS BEING 15 mm, AND SEPARATION DISTANCE BETWEEN HOLE PORTIONS CENTERS BEING 195 mm)

BEARING WALL AND WALL SURFACE MEMBER FOR BEARING WALL

TECHNICAL FIELD

The present invention relates to a bearing wall and to a wall surface member for a bearing wall used, for example, in a steel house or a pre-fabricated home.

BACKGROUND ART

Hitherto, bearing walls including joined wall surface members, such as steel sheets on frame members, have been employed in buildings such as steel houses or pre-fabricated homes (see, for example, Japanese Patent No. 3737368). Such bearing walls are designed so that, when applied with an earthquake load, sheer stress occurs in a wall surface member, and an axial force occurs in a frame member.

The bearing wall described in Japanese Patent No. 3737368 is configured by a frame assembled into a rectangular shaped frame of frame members around the periphery of a steel sheet (wall surface member), and by cross-members provided inside the frame. Plural holes are formed in regions of the steel sheet (the wall surface member) other than portions where the frame members are joined, distributed in the height direction and the horizontal direction (width direction). Ribs integrated to the steel sheet are formed with circular tube shapes or truncated circular cone shapes at the edge portions of these holes. The ribs are formed to reinforce the external face of the steel sheet.

SUMMARY OF INVENTION

Technical Problem

However, with the bearing wall described in Japanese Patent No. 3737368, there is an issue in that it is difficult to stabilize and absorb earthquake energy.

In consideration of the above circumstances, an object of the present invention is to provide a bearing wall, and a wall surface member for use in a bearing wall, that are capable of stabilizing and absorbing earthquake energy.

Solution to Problem

A bearing wall according to the present invention includes: a pair of vertical members that are joined to upper and lower horizontal members of a building so as to be spaced apart in a horizontal direction; and a wall surface member that includes a first joint portion joined to one of the vertical members, that includes a second joint portion joined to another of the vertical members, and that includes circular-shaped opening portions that are spaced apart in an up-down direction between the pair of vertical members so as to be disposed in a single column. A separation distance between a center of one opening portion and a center of an opening portion that is adjacent to the one opening portion in the up-down direction is shorter than a horizontal separation distance between the first joint portion and the second joint portion.

A wall surface member for a bearing wall according to the present invention includes: a first joint portion configured to join to one vertical member; a second joint portion configured to join to another vertical member and having a fixed spacing from the first joint portion; and circular shaped opening portions that are disposed so as to be spaced apart from each other in a single column along the first joint portion and the second joint portion, between the first joint portion and the second joint portion. A separation distance between a center of one opening portion and a center of an opening portion that is adjacent to the one opening portion in the up-down direction is shorter than a separation distance between the first joint portion and the second joint portion.

According to the bearing wall and the wall surface member for a bearing wall according to the present invention, due to forming plural opening portions in the wall surface member so as to be disposed along the up-down direction, when earthquake load acts, stress concentrates at up-down direction intermediate portions of the wall surface member between opening portions that are adjacent to each other in the up-down direction, and stress concentrates at horizontal direction intermediate portions of the wall surface member between the first joint portion and the opening portions, and stress concentrates at horizontal direction intermediate portions of the wall surface member between the second joint portion and the opening portions. In the present invention, the separation distance between a center of one opening portion and a center of an opening portion that is adjacent to the one opening portion in the up-down direction is shorter than a separation distance between the first joint portion and the second joint portion. Thus, when earthquake load acts on the wall surface member, this thereby enables the shear stress values of horizontal direction intermediate portions of the wall surface member between the first joint portion and the opening portions, and the shear stress values of horizontal direction intermediate portions of the wall surface member between the second joint portion and the opening portions to be made lower than the shear stress values at up-down direction intermediate portions of the wall surface member between opening portions that are adjacent to each other in the up-down direction. The shear stress force along the horizontal direction occurring in the pair of vertical members is thereby reduced. Thus, as a result, this suppresses the join portions, between the wall surface member and the pair of vertical members, from deforming prior to deformation of the up-down direction intermediate portions of the wall surface member between the one opening and another opening of adjacent opening portions in the up-down direction, enabling earthquake energy to be stabilized and absorbed.

Advantageous Effects of Invention

The bearing wall and the wall surface member for a bearing wall according to the present invention have the excellent advantageous effect of enabling earthquake energy to be stabilized and absorbed.

BRIEF DESCRIPTION OF DRAWINGS

FIG. 6A is a diagram illustrating stress acting on wall surface members having circular arc portions of different radii to each other.

FIG. 7A is a diagram illustrating stress acting on wall surface members having circular arc portions of different radii to each other.

FIG. 9A is a diagram illustrating stress acting on wall surface members having ring-shaped ribs of different height dimensions to each other.

FIG. 11A is a diagram illustrating stress acting on wall surface members having different separation distances between opening portions to each other.

DESCRIPTION OF EMBODIMENTS

First Exemplary Embodiment

Explanation follows regarding a bearing wall according to an exemplary embodiment of the present invention, with reference to FIG. 1A, FIG. 1B, FIG. 2A, FIG. 2B, and FIG. 3.

Figure 1A:
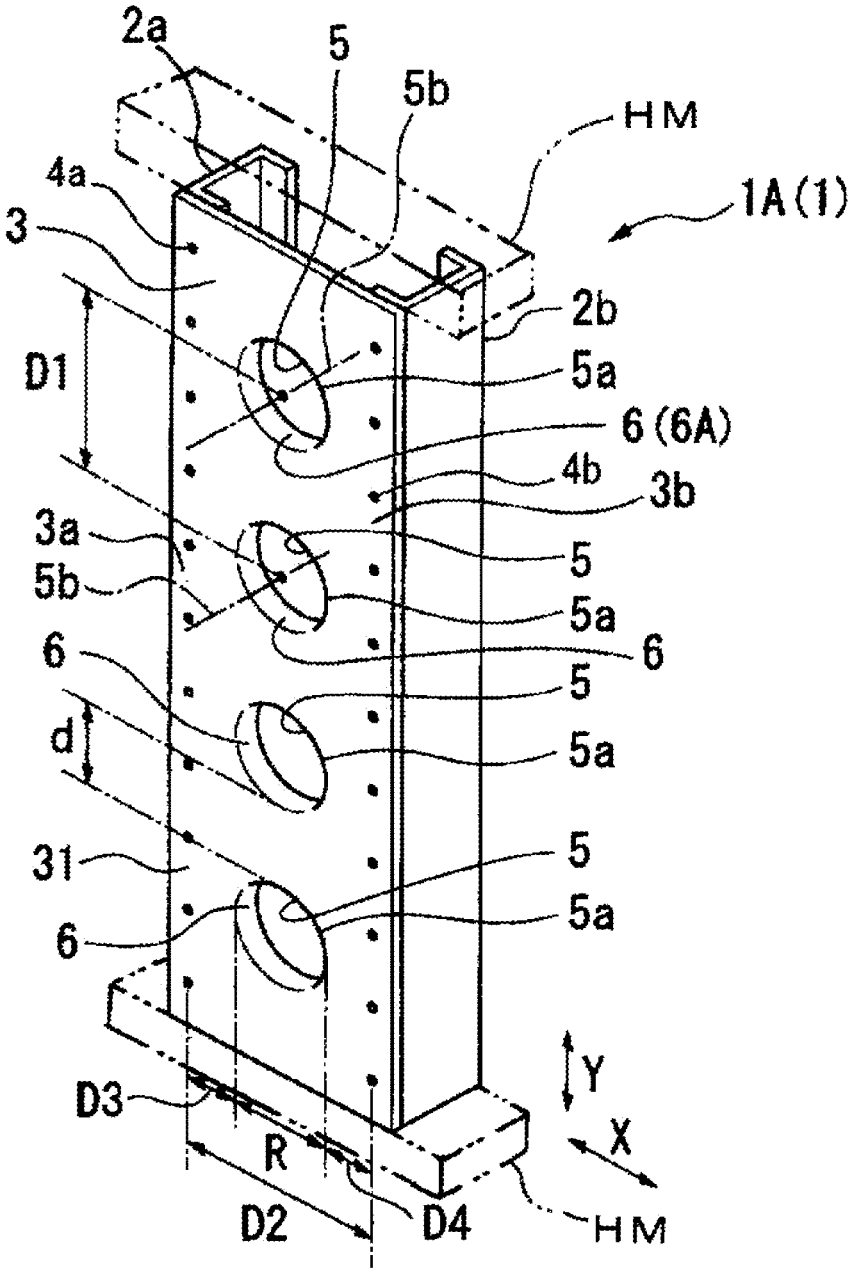
FIG. 1A is a perspective view illustrating an example of a bearing wall according to a first exemplary embodiment, as viewed from a wall surface member side.

As illustrated in FIG. 1A, a bearing wall 1A (1) according to the present exemplary embodiment includes a pair of vertical members 2*a*, 2*b* that extend in an up-down direction Y of the building, are disposed at a specific spacing from each other, and are joined to upper and lower horizontal members HM of a building, and a wall surface member 3 that is joined to the pair of vertical members 2*a*, 2*b*.

The pair of vertical members 2*a*, 2*b* are, for example, formed from steel sections, such as channel steel or angle steel, of thin, lightweight steel. In the present exemplary embodiment, channel steel with a substantially U-shaped cross-section is employed for the pair of vertical members 2*a*, 2*b*.

The wall surface member 3 is configured from a steel sheet having a substantially rectangular shape when viewed face on, and one edge portion 3*a* in the width direction X is joined to one vertical member 2*a* from out of the pair of vertical members 2*a*, 2*b*, and another edge portion 3*b* in the width direction X is joined to the other vertical member 2*b*. In the present exemplary embodiment, the one edge portion 3*a* of the wall surface member 3 is joined to the one vertical member 2*a* by inserting plural drill screws through the one edge portion 3*a* of the wall surface member 3 and through the one vertical member 2*a*. Note that the portions in the wall surface member 3 through which the drill screws are inserted are referred to as first joint portions 4*a*. The first joint portions 4*a* are disposed at a substantially even spacing apart in the up-down direction. The other edge portion 3*b* of the wall surface member 3 is joined to the other vertical member 2*b* by inserting plural drill screws through the other edge portion 3*b* of the wall surface member 3 and the vertical member 2*b*. Note that the portions in the wall surface member 3 through which the drill screws are inserted are referred to as second joint portions 4*b*. The second joint portions 4*b* are, similarly to the first joint portions 4*a*, disposed at a substantially even spacing apart in the up-down direction.

Plural circular shaped opening portions 5 are formed in the wall surface member 3, disposed in a single line at a specific spacing apart in the up-down direction Y. The plural opening portions 5, 5, . . . are preferably formed with substantially the same diameter R as each other, and are preferably disposed such that distances d between adjacent opening portions 5, 5 are substantially the same dimensions as each other. These opening portions 5 are disposed so as to run along the width direction X central line axis of the wall surface member 3. A distance D1 between central axes 5*b*, 5*b* of adjacent opening portions 5, 5 in the up-down direction is set so as to be shorter than a distance D2 between joints between the pair of vertical members 2*a*, 2*b* and the wall surface member 3. The distance D2 between joints between the pair of vertical members 2*a*, 2*b* and the wall surface member 3 indicates a distance in the horizontal direction between the first joint portions 4*a* and the second joint portions 4*b*.

This thereby enables the minimum length of a flat sheet portion 31 between adjacent opening portions 5, 5 in the up-down direction (equivalent to the distance d between adjacent opening portions 5, 5) to be set shorter than the sum of a horizontal distance D3 between the opening portion 5 and the first joint portion 4*a*, and the horizontal distance D4 between the opening portion 5 and the second joint portion 4*b*, wherein the flat sheet portion 31 serves as a general portion and is a flat portion of the wall surface member 3 not formed with the opening portions 5 or with ring-shaped ribs 6, described later.

Figure 1B:
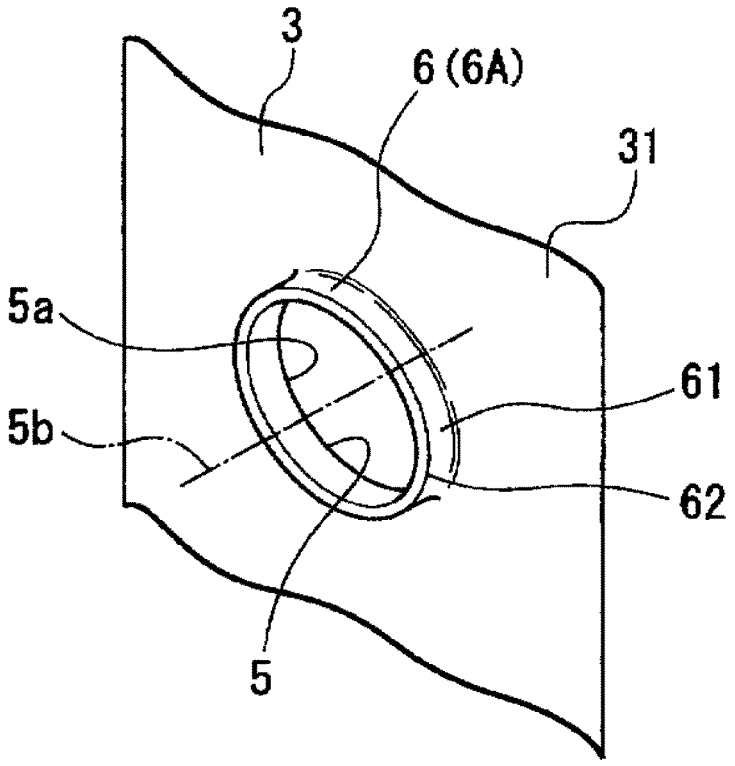
FIG. 1B is an expanded perspective view illustrating the bearing wall illustrated in FIG. 1A, as viewed from a vertical member side.

As illustrated in FIG. 1A and FIG. 1B, preferably ring-shaped ribs (burrings) 6 (6A) integrally formed to the steel sheet of the wall surface member 3 are formed to an edge portion 5*a* of each of the opening portions 5. The ring-shaped ribs 6 project out toward one side in a direction out of the plane of the wall surface member 3 (a direction orthogonal to the wall surface member 3). The one side in a direction out of the plane of the wall surface member 3 is the side where the pair of vertical members 2*a*, 2*b* are joined to the wall surface member 3 (see FIG. 1A).

Figure 2A:
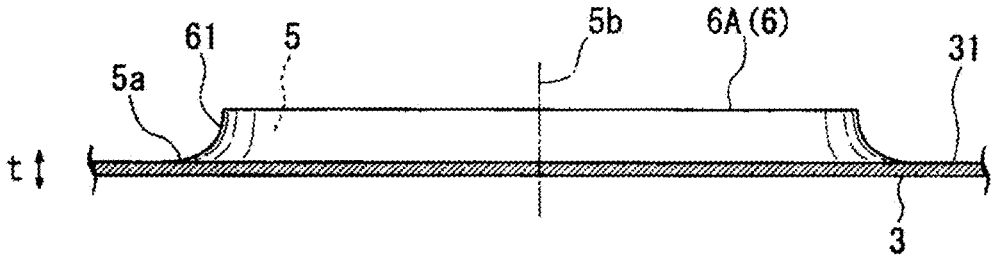
FIG. 2A is a side view of a ring-shaped rib formed to the wall surface member of the bearing wall illustrated in FIG. 1A.
Figure 2B:
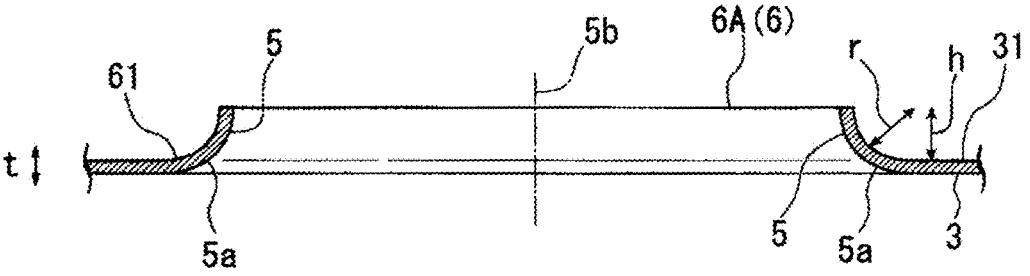
FIG. 2B is a cross-section of the ring-shaped rib illustrated in FIG. 2A.

As illustrated in FIGS. 2A and 2B, a substantially circular arc shape, when viewed in transverse cross-section, is formed to the radial direction inside face of each of the ring-shaped ribs 6, and the face of each of the ring-shaped ribs 6 on the radial direction inside narrows on moving away from the flat sheet portion 31. The inner diameter of the ring-shaped ribs 6 accordingly reduces on progression in the direction out of the plane of the wall surface member 3.

Next, explanation follows regarding the manner in which stress acts on the wall surface member 3 when earthquake load acts on the above-described bearing wall 1A.

Figure 3:
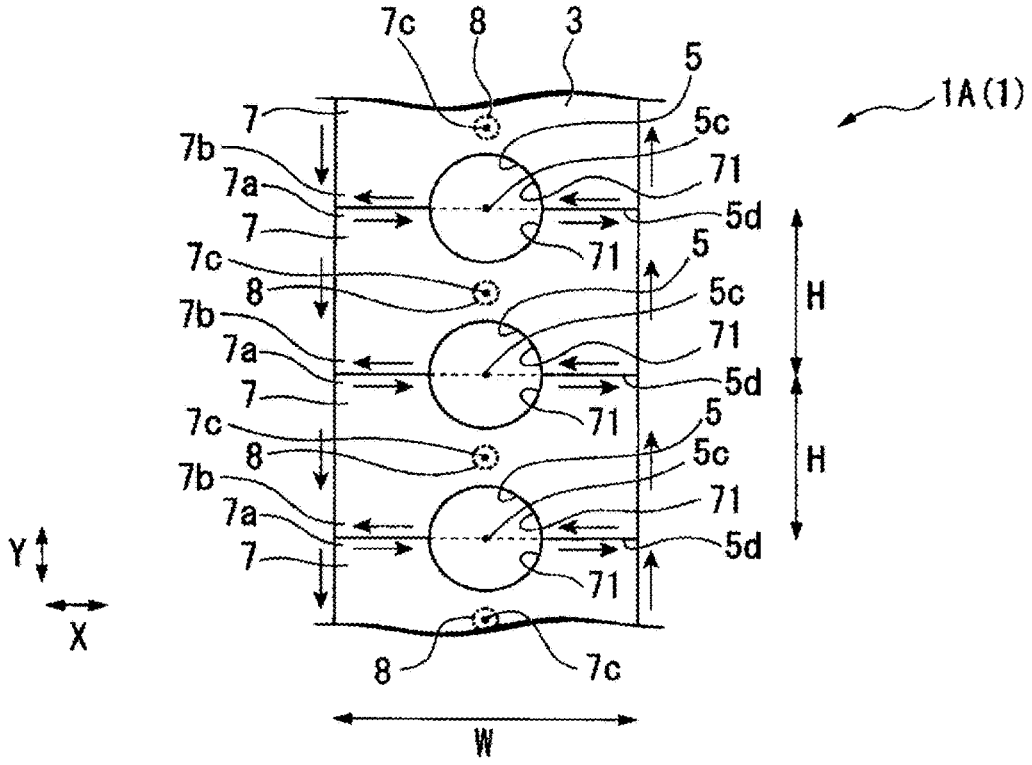
FIG. 3 is an explanatory diagram of stress acting on a bearing wall.

As illustrated in FIG. 3, consider a case in which a wall surface member 3 is configured from plural units 7 segmented at horizontal lines 5*d* passing through centers 5*c* of each of the opening portions 5 (intersections between the face of the wall surface member 3 and the central axes 5*b*, see FIG. 1), wherein sheer stress τ and bending stress σ act on a single unit 7.

The units 7 have a width dimension W that is the same value as the width dimension of the wall surface member 3, and have a height dimension H that is the same value as the length dimension of a straight line connecting together centers 5*c* of adjacent opening portions 5, 5. Semicircular shaped cutouts 71, 71 equivalent to the lower half or the upper half of the opening portions 5 are formed at width direction X central portions of the upper ends 7*a* and the lower ends 7*b*.

A shear stress τ occurs in each of the units 7 when an earthquake load acts on the bearing wall 1A in the horizontal direction. As described above, in the present exemplary embodiment, the separation distance between the semicircular shaped cutouts 71 formed in the upper ends 7*a* and the semicircular shaped cutouts 71 formed in the lower ends 7*b* (equivalent to distance d) is shorter than the sum of a horizontal distance D3 between the opening portions 5 and the first joint portion 4*a*, and the horizontal distance D4 between the opening portions 5 and the second joint portion 4*b*. Namely, within the units 7 illustrated in FIG. 3, the location between a pair of adjacent opening portions 5, 5 is the location of minimum cross-sectional area within the unit 7. As a result, when earthquake load acts on the bearing wall 1A, the shear stress τ is concentrated in the vicinity of center portions 7*c* of each of the units 7 in the up-down direction Y and the width direction X. The vicinity of a center portion 7*c* of each of the units 7 where the shear stress τ concentrates is referred to as a stress concentration portion 8.

The directions (horizontal directions) in which the shear stress τ act are the opposite directions to each other at the upper end 7*a* side and the lower end 7*b* side of the unit 7. Due to there being plural of the units 7 disposed along the up-down direction, and due to there being, in practice, plural units 7 integrated together with each other, the shear stress τ acting in the vicinity of the lower end 7*b* of the unit 7 on the upper side of adjacent units 7, 7, and the shear stress τ acting in the vicinity of the upper end 7*a* of the unit 7 on the lower side thereof, cancel each other out. Thus in the units 7, the shear stress τ concentrates at each of the stress concentration portions 8, and the horizontal direction shear stress τ acting at the two horizontal direction end portions is reduced, such that stress from the units 7 to the pair of vertical members 2*a*, 2*b* is transmitted in the vertical direction, with hardly any transmission of stress in the horizontal direction.

Moreover, a bending stress σ occurs at an edge portion of each of the cutouts 71 (the edge portion 5*a* of each of the opening portions 5) when earthquake load acts on the bearing wall 1A. Due to the ring-shaped ribs 6 being formed to the edge portions of the cutouts 71, the bending stress σ at this time is distributed to the ring-shaped ribs 6 and to the flat sheet portion 31 in the vicinity of the ring-shaped ribs 6, enabling deformation of the opening portions 5 to be suppressed.

Due to the above, the shear stress τ that occurs in the bearing wall 1A concentrates at the stress concentration portion 8, horizontal direction stress is hardly transmitted to the pair of vertical members 2*a*, 2*b*, and the bending stress σ occurring at the edge portions of the opening portions 5 is distributed.

Thus when an earthquake load of a specific value or greater acts on the bearing wall 1A, shear stress is concentrated at the stress concentration portions 8 of the wall surface member 3, and the wall surface member 3 deforms and fails. However, there is little horizontal direction shear stress transmitted from the wall surface member 3 to the pair of vertical members 2*a*, 2*b*, thereby enabling the joint portions between the pair of vertical members 2*a*, 2*b* and the wall surface member 3 (the first joint portions 4*a* and the second joint portions 4*b*) to be suppressed from failing, and enabling local deformation of the pair of vertical members 2*a*, 2*b* to be suppressed.

By distributing the bending stress σ acting in the vicinity of the edge portion 5*a* of each of the opening portions 5, the value of the bending stress σ acting in the vicinity of the edge portion 5*a* of each of the opening portions 5 can be made smaller than the value of the shear stress τ concentrated at the stress concentration portion 8, enabling shear failure to be caused at the stress concentration portion 8 before deformation of the opening portions 5 occurs. The stress concentration portion 8 of the wall surface member 3 is a structure that undergoes shear yielding when earthquake load of a specific value or greater acts on the bearing wall 1A, prior to failure of the joint portions 4*a*, 4*b* between the pair of vertical members 2*a*, 2*b* and the wall surface member 3 and prior to local deformation of the pair of vertical members 2*a*, 2*b*, thereby enabling earthquake energy to be stabilized and absorbed. Moreover, the present exemplary embodiment also enables a configuration not installed with cross-members or the like to counteract horizontal direction shear stress transmitted from the wall surface member to the vertical members 2*a*, 2*b*.

Even in cases in which the ring-shaped ribs 6 are provided, due to the ring-shaped ribs 6 projecting out from the side of the joints between the wall surface member 3 and the pair of vertical members 2*a*, 2*b*, and due to there being no projection portion on the face on the opposite side to the joint face between the wall surface member 3 to the pair of vertical members 2*a*, 2*b*, interior and exterior finishing work is relatively easier to perform than for bearing walls having undulations on both faces of the wall surface member 3, and handling of the bearing wall 1A becomes easier.

Second Exemplary Embodiment

Next, explanation follows regarding a bearing wall according to a second exemplary embodiment, with reference to the appended drawings. The same reference numerals are appended to similar parts and portions to those of the first exemplary embodiment described above, duplicate explanation thereof will be omitted, and configuration that differs from that of the first exemplary embodiment will be explained.

Figure 4A:
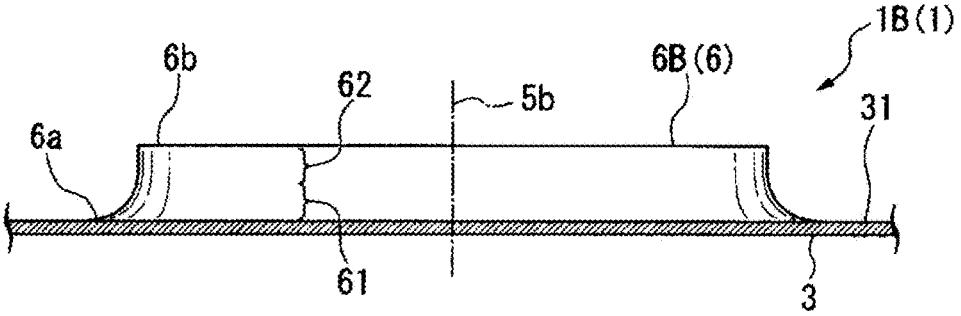
FIG. 4A is a side view of a ring-shaped rib formed to a wall surface member of a bearing wall according to a second exemplary embodiment.
Figure 4B:
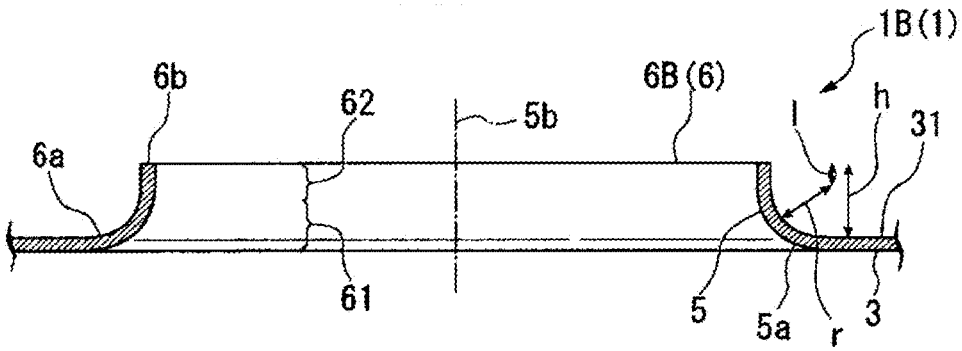
FIG. 4B is a cross-section of the ring-shaped rib illustrated in FIG. 4A.

As illustrated in FIG. 4A and FIG. 4B, in a bearing wall 1B (1) according to the second exemplary embodiment, the cross-section profile of each ring-shaped rib 6B (6) along the opening portion 5 radial direction is formed with a circular arc shaped base end portion 6*a*, with a straight-line shape orthogonal to a flat sheet portion 31 at a leading end portion 6*b* side on the opposite side to that of the base end portion 6*a*. The internal diameter of the base end portion 6*a* of the ring-shaped ribs 6 decreases on moving away from the flat sheet portion 31, with the leading end portion 6*b* side of each of the ring-shaped ribs 6 configuring a circular tube shape of fixed internal diameter.

Explanation follows regarding a circular arc portion 61 that is a portion having a circular arc shape in cross-section, as on the base end portion 6*a* side of each of the ring-shaped ribs 6, and a straight line portion 62 that is a portion having a cross-section profile that is a straight-line shape orthogonal to the flat sheet portion 31, as at the leading end portion 6*b* side. The circular arc portion 61 and the straight line portion 62 are contiguous to each other.

In the present exemplary embodiment, as illustrated in FIG. 4B, the circular arc portion 61 is formed so as to have a cross-section profile of a quarter circle of radius r=10 mm. The straight line portion 62 is formed so as to have a cross-section profile of a straight line of length l=5 mm. The height dimension h of the ring-shaped ribs 6 is 15 mm. Note that the ring-shaped ribs 6A of the bearing wall 1A according to the first exemplary embodiment illustrated in FIG. 2A and FIG. 2B are formed with the circular arc portions 61 alone, and are of a form not formed with the straight line portions 62 of the ring-shaped ribs 6B of the second exemplary embodiment. The bearing wall 1B according to the second exemplary embodiment, as illustrated in FIG. 4A and FIG. 4B, exhibits similar operation and advantageous effects to those of the first exemplary embodiment, due to the circular arc portions 61 and the straight line portions 62 of the ring-shaped ribs 6B being capable of distributing the bending stress acting in the vicinity of the edge portion 5*a* of each of the opening portions 5 when earthquake load acts on the bearing wall 1B.

Differences in the stress acting on the bearing wall due to different forms of opening portions and ring-shaped ribs on the bearing wall were analyzed. Explanation follows regarding such analysis.

Five examples are given here as parameters of forms of the opening portions 5 and the ring-shaped ribs 6 of the bearing wall 1: (1) a radius r of the circular arc portion 61 of the ring-shaped ribs 6 (see FIG. 2); (2) a height dimension h of the ring-shaped ribs 6 (see FIG. 2); (3) a distance d between adjacent opening portions 5, 5 (see FIG. 1); (4) a sheet thickness t of the wall surface member 3 (see FIG. 2); and (5) a diameter R of the opening portions 5 (see FIG. 1). Tests and structural analysis using finite element method (FEM) elastic analysis were performed in order to investigate the relationship between these parameters and stress acting on the wall surface member 3.

Figure 5A:
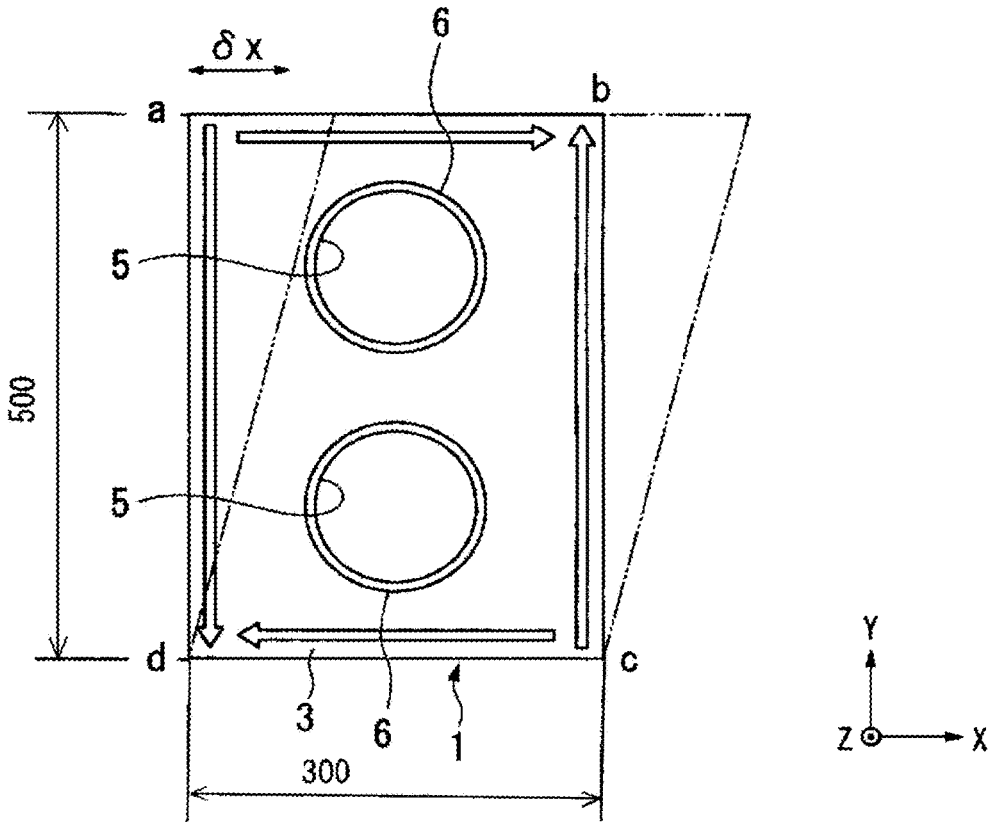
FIG. 5A is an explanatory diagram of a test specimen.
Figure 5B:
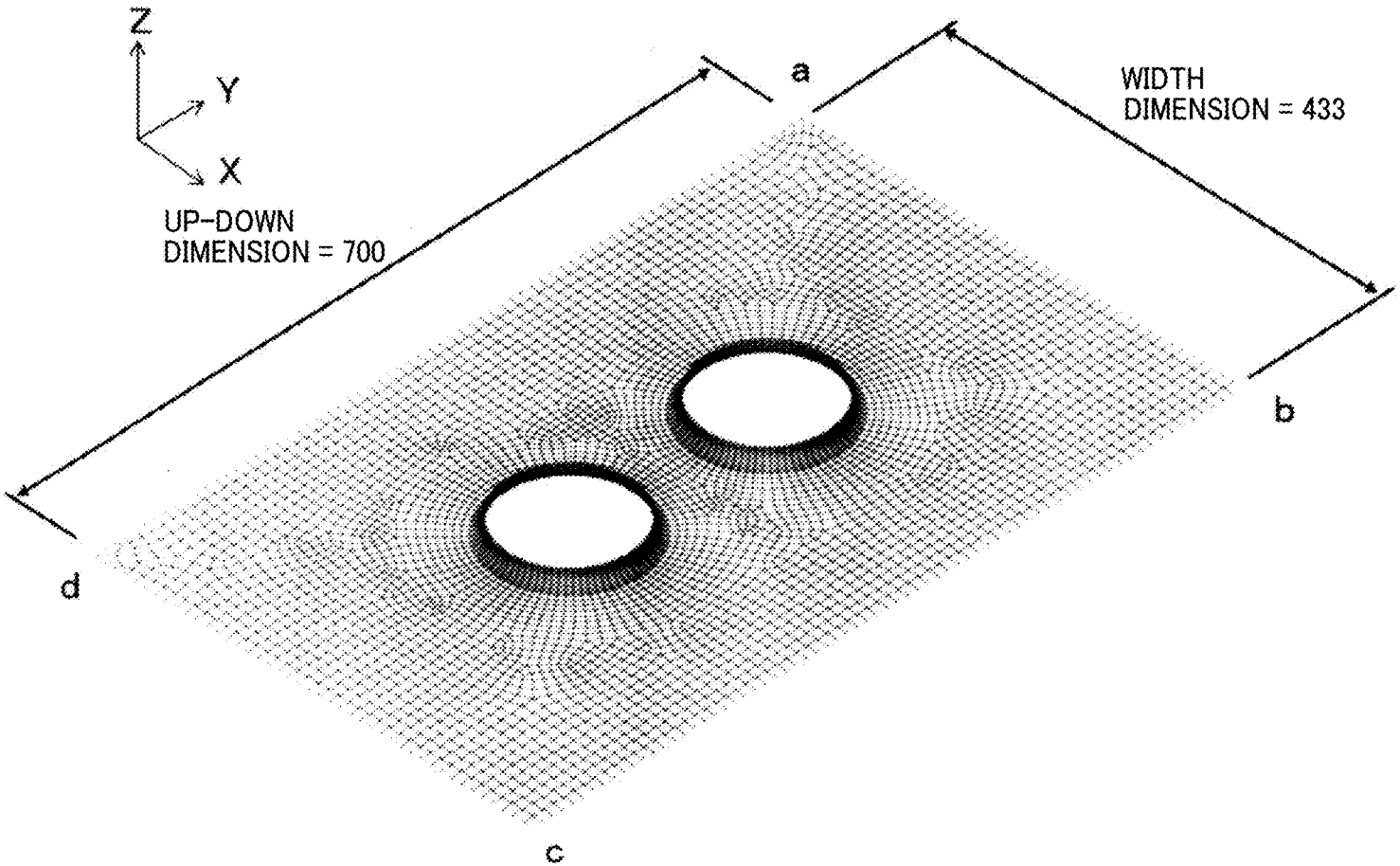
FIG. 5B is an explanatory diagram of another test specimen.
Figure 6B:
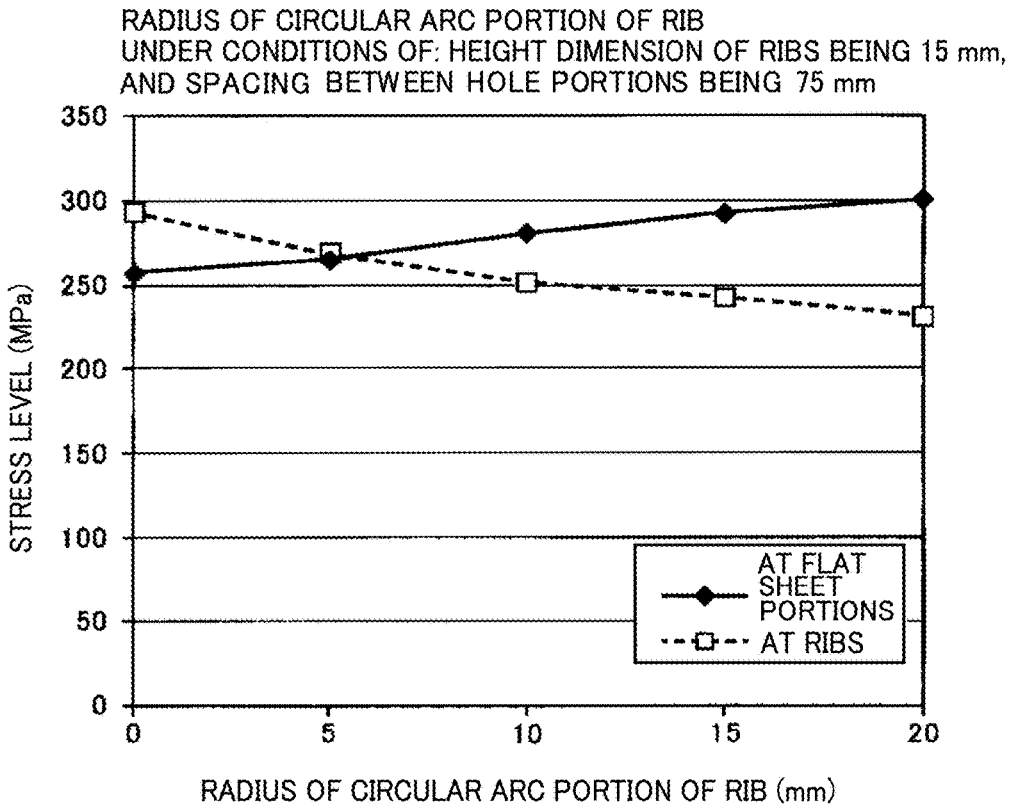
FIG. 6B is a graph illustrating relationships between radii of circular arc portions and stress acting on wall surface members.
Figure 7B:
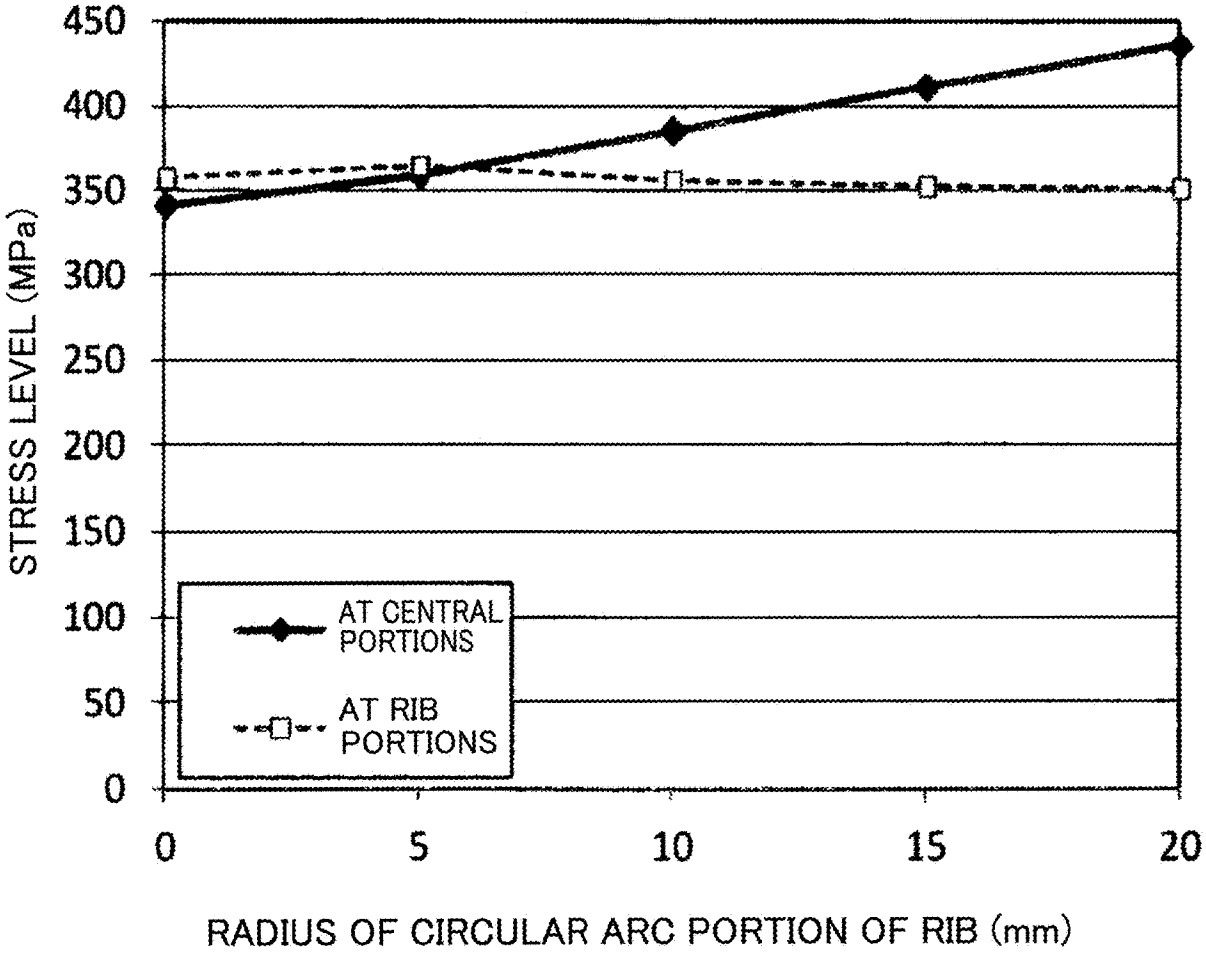
FIG. 7B is a graph illustrating relationships between the radius of circular arc portions and stress acting on wall surface members.
Figure 8A:
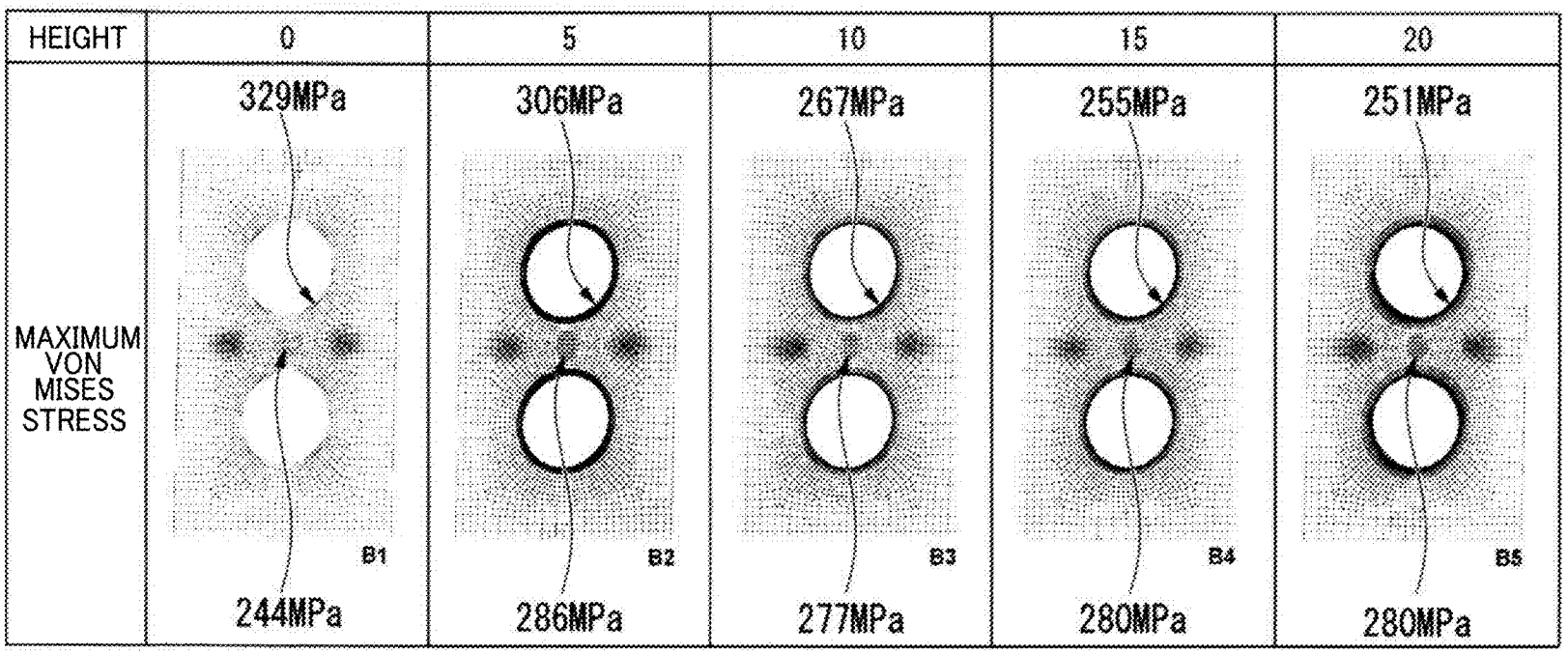
FIG. 8A is a diagram illustrating stress acting on wall surface members having ring-shaped ribs of different height dimensions to each other.
Figure 8B:
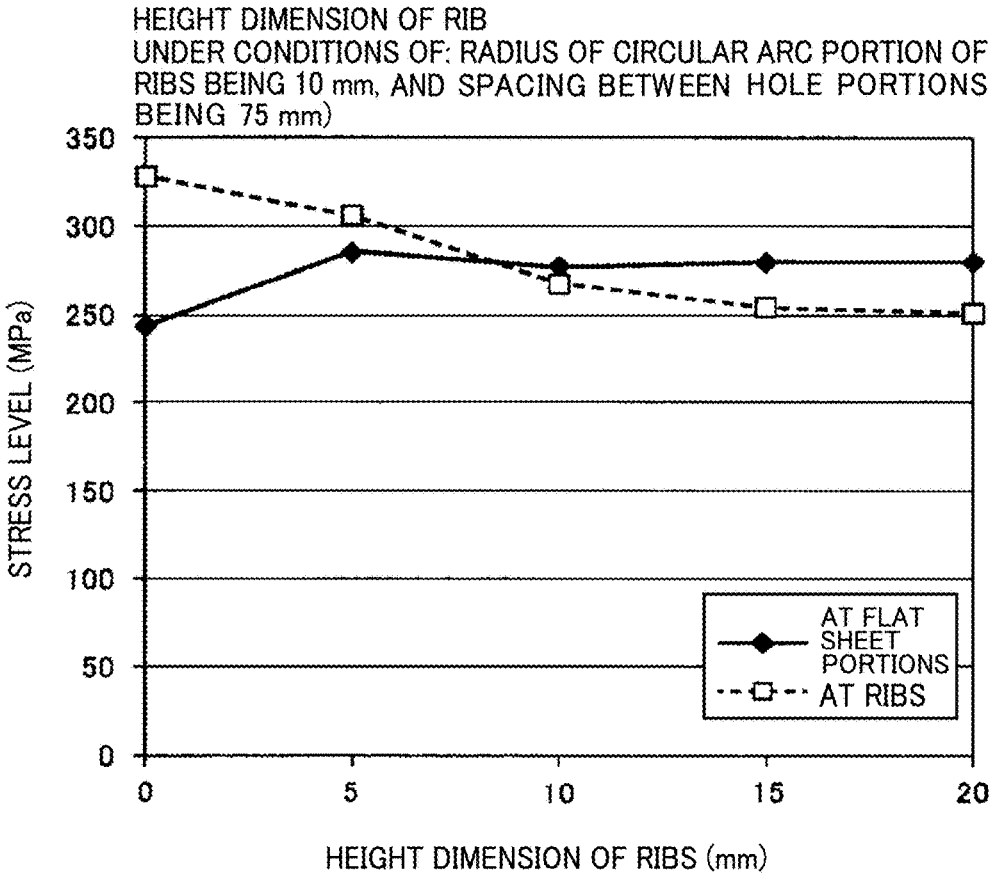
FIG. 8B is a graph illustrating relationships between the height dimension of ring-shaped ribs and stress acting on wall surface members.

In the tests, forced displacement in the horizontal direction was imparted to plural test specimens having different forms of the circular shaped opening portions 5 and ring-shaped ribs 6, and the stress occurring in the wall surface member 3 measured. As illustrated in FIG. 5A and FIG. 5B, the test specimens of the bearing wall 1 either employed a steel sheet for the wall surface member 3 having an up-down dimension of 500 mm and a width dimension of 300 mm, or a steel sheet having an up-down dimension of 700 mm and a width dimension of 433 mm. Two circular shaped opening portions 5, 5 were formed in these wall surface members 3 at a specific spacing apart in the up-down direction Y. For the wall surface member 3 test specimens, an FEM elastic analysis mesh was also generated having a spacing of 10 mm in the up-down direction Y and width direction X, and an FEM elastic analysis mesh was generated having a spacing of 5 mm at the periphery of the opening portions 5.

Bar members (not illustrated in the drawings) corresponding to the pair of vertical members 2*a*, 2*b* (see FIG. 1), were joined to the sides (side ad, side bc) of the wall surface member 3 extending in the up-down direction Y, and joint portions 4 (see FIG. 1) between the wall surface member 3 and the pair of vertical members 2*a*, 2*b* were joined by pin joining. The nodes on the upper side (side ab) of the wall surface member 3 were accordingly capable of displacing in the X direction, and capable of rotating about the Z axis. The nodes on the lower side (side dc) of the wall surface member 3 were capable of rotating about the Z axis. Forced displacement, of δX=0.634 mm (for the wall surface member 3 employing the steel sheet of up-down dimension 500 mm and width dimension of 300 mm) and δX=0.8876 mm (for the wall surface member 3 employing the steel sheet having an up-down dimension of 700 mm and a width dimension of 433 mm), was imparted to the side ab of the wall surface member 3 of the bearing wall 1 in the X direction, and the stress acting on the wall surface member 3 analyzed. Due to the presence of the opening portions and the ring-shaped ribs, and of the joint portions, the shear stress, the tensile stress, and the compression stress on the wall surface member 3 occur in a complicated manner, and so, in a comparison of the magnitude of the stress at each location, the stress at each location was compared by using values converted into von Mises stress.

(1) Relationship Between Radius r of the Circular Arc Portion 61 and Stress Acting on the Wall Surface Member 3

Forced displacement was imparted to ten test specimens having different radii r of the circular arc portion 61 of the ring-shaped ribs 6, these being A1 to A5 (for the wall surface member 3 employing the steel sheet of up-down dimension 500 mm and width dimension of 300 mm) and A'1 to A'5 (for the wall surface member 3 employing the steel sheet having an up-down dimension of 700 mm and a width dimension of 433 mm), and the relationship between the radius of the circular arc portion 61 of the ring-shaped ribs 6 and the stress acting on the wall surface member 3 was analyzed. The radius r of the circular arc portion 61 on the test specimens A1 to A5, and on the test specimens A'1 to A'5, in the sequence of the test specimens A1 to A5 and of the test specimens A'1 to A'5, was: 0 mm, 5 mm, 10 mm, 15 mm, and 20 mm; and the height dimension h of the ring-shaped ribs 6 was 15 mm in all cases.

The test specimens A2, A3, A'2, A'3 having a radius r of the circular arc portion 61 of 5 mm or 10 mm had the circular arc portion 61 and the straight line portion 62 formed to each of the ring-shaped ribs 6, as in the second exemplary embodiment.

The test specimens A4, A5, A'4, A'5 having a radius r of the circular arc portion 61 of 15 mm or 20 mm had the circular arc portion 61 alone formed to each of the ring-shaped ribs 6, as in the first exemplary embodiment, and the straight line portion 62 was not formed.

The test specimens A1, A'1 having a radius r of the circular arc portion 61 of 0 mm had the straight line portion 62 alone forming the circular tube shaped ring-shaped ribs 6, and the circular arc portion 61 was not formed to the ring-shaped ribs 6.

In the test specimens A1 to A5, A'1 to A'5, the diameter R of the opening portions 5 was 120 mm, the distance d between opening portions 5, 5 was 75 mm, and the sheet thickness t of the flat sheet portion 31 was 1.2 mm.

As illustrated in FIG. 6A to FIG. 7B, it is apparent that the larger the radius r of the circular arc portion 61, the more widely the bending stress acting at the vicinity of the edge portion 5*a* of the opening portions 5 is distributed, and the greater the shear stress acting on the stress concentration portions 8. It is apparent from FIG. 6B and FIG. 7B, that maximum von Mises stress at the stress concentration portions 8 and the maximum von Mises stress acting in the vicinity of the edge portions 5*a* of the opening portions 5 are the same values as each other for cases in which the radius r of the circular arc portion 61 is approximately 5 mm. Moreover, it is also apparent that the maximum von Mises stress acting on the stress concentration portions 8 is greater than the maximum von Mises stress acting at the vicinity of the edge portions 5*a* of the opening portions 5 for cases in which the radius r of the circular arc portion 61 is approximately 5 mm or greater. It is accordingly apparent that the radius of the circular arc portion 61 is preferably 5 mm or greater for cases in which the diameter of the opening portions 5 is 120 mm, the distance d between adjacent opening portions 5, 5 is 75 mm, the height dimension h of the ring-shaped ribs 6 is 15 mm, and the sheet thickness t of the flat sheet portion 31 is 1.2 mm.

Moreover, it is apparent from FIG. 6A to FIG. 7B that the bearing wall 1 of the test specimens A2 to A5 and A'2 to A'5 formed with the circular arc portions 61 on the ring-shaped ribs 6 distributed the bending stress acting at the vicinity of the edge portion 5*a* of the opening portions 5 more widely than the bearing wall of the test specimens A1, A'1 not formed with the circular arc portions 61 on the ring-shaped ribs 6. Moreover, it is apparent that, for the same height dimension h of the ring-shaped ribs 6, the bearing wall 1 formed with the circular arc portion 61 alone on the ring-shaped ribs 6, as in the test specimens A4, A5, A'4, A'5 distributed the bending stress acting at the vicinity of the edge portion 5*a* of the opening portions 5 more widely than the bearing wall of the test specimens A2, A3, A'2, A'3 formed with the circular arc portions 61 and the straight line portions 62 on the ring-shaped ribs 6. Furthermore, it is apparent that as the proportion of the ring-shaped ribs 6 occupied by the circular arc portion 61 increases, the more widely the bending stress acting at the vicinity of the edge portion 5*a* of the opening portions 5 can be distributed in cases in which both the circular arc portions 61 and the straight line portions 62 are formed to the ring-shaped ribs 6 as in the test specimens A2, A3, A'2, A'3.

(2) Relationship Between Height Dimension h of the Ring-Shaped Ribs 6 and Stress Acting on the Wall Surface Member 3.

Next, forced displacement was imparted to ten test specimens having different height dimensions h of the ring-shaped ribs 6, these being B1 to B5 and B'1 to B'5, and the stress acting on the wall surface member 3 was analyzed.

The height dimension h of the ring-shaped ribs 6 of the test specimens B1 to B5 and B'1 to B'5, in the sequence of the test specimens B1 to B5 and B'1 to B'5, was: 0 mm, 5 mm, 10 mm, 15 mm, and 20 mm.

The test specimens B1, B1' here have a form in which the height dimension h of the ring-shaped ribs 6 is 0 mm, and the opening portions 5 alone are formed to the wall surface member 3, without the ring-shaped ribs 6.

Moreover, the radius of the circular arc portions 61 of the ring-shaped ribs 6 was 10 mm in all of the test specimens B1 to B5 and B'1 to B'5. Therefore, the straight line portions 62 were not formed to the ring-shaped ribs 6 in the test specimens B2, B3 having a height dimension h of the ring-shaped ribs 6 of 5 mm or 10 mm, and the circular arc portions 61 and the straight line portions 62 were formed to the ring-shaped ribs 6 in the test specimens B4, B5, B'4, B'5 having a height dimension h of the ring-shaped ribs 6 of 15 mm or 20 mm. Note that due to the height dimension h of the ring-shaped ribs 6 being 5 mm and the radius of the circular arc portion 61 being smaller than 10 mm in the test specimens B2, B'2, the cross-section shape of the circular arc portion 61 is a circular arc shape in which a smaller angle than 90 degrees is formed.

In the test specimens B1 to B5 and B'1 to B'5, the diameter of the opening portions 5 was 120 mm, the distance d between adjacent opening portions 5, 5 was 75 mm, and the sheet thickness t of the flat sheet portion 31 was 1.2 mm.

Figure 9B:
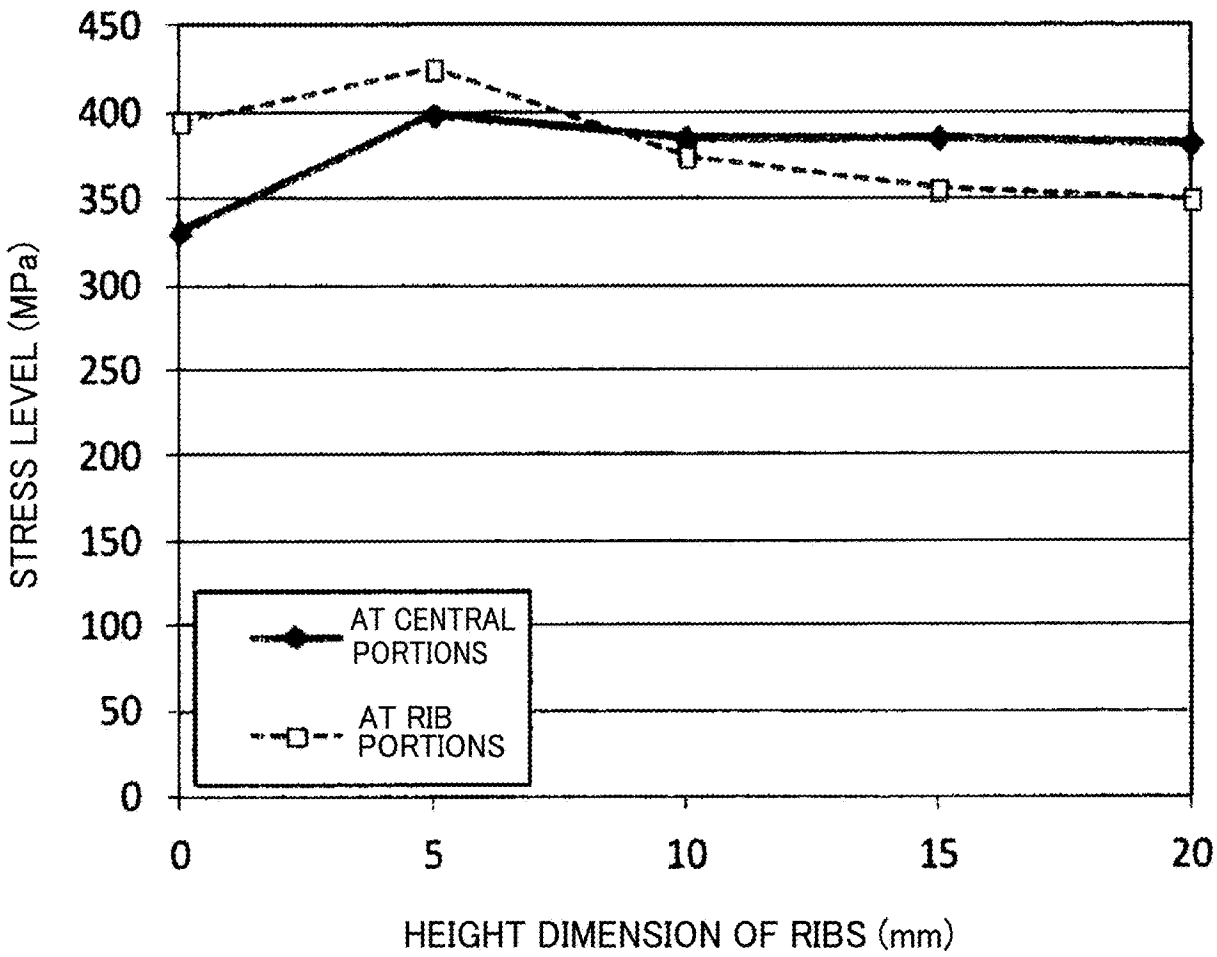
FIG. 9B is a graph illustrating relationships between the height dimension of ring-shaped ribs and stress acting on wall surface members.

As illustrated in FIG. 8A to FIG. 9B, it is apparent that the greater the height dimension h of the ring-shaped ribs 6, the more widely the bending stress acting at the vicinity of the edge portion 5*a* of the opening portions 5 is distributed. Moreover, the shear stress acting on the stress concentration portion 8 is larger when the ring-shaped ribs 6 are present (test specimens B2 to B5 and B'2 to B'5) than in cases in which there are no ring-shaped ribs 6 present (test specimens B1 and B'1), however, it is apparent that there is hardly any change in the shear stress acting on the stress concentration portion 8 even when the height dimension h of the ring-shaped ribs 6 is changed. As illustrated in FIG. 8B and FIG. 9B, it is also apparent that the maximum von Mises stress at the stress concentration portions 8 and the maximum von Mises stress acting at the vicinity of the edge portions 5*a* of the opening portions 5 are the same value when the height dimension h of the ring-shaped ribs 6 is about 8.5 mm. Moreover, it is also apparent that the maximum von Mises stress acting on the stress concentration portions 8 is larger than the maximum von Mises stress acting at the vicinity of the edge portions 5*a* of the opening portions 5 in cases in which the height dimension h of the ring-shaped ribs 6 is approximately 8.5 mm or greater. Thus in cases in which the diameter of the opening portions 5 was 120 mm, the distance d between adjacent opening portions 5, 5 was 75 mm, the radius of the circular arc portion of the ring-shaped ribs 6 was 10 mm, and the sheet thickness t of the flat sheet portion 31 was 1.2 mm, it is apparent that the height dimension h of the ring-shaped ribs 6 is preferably 8.5 mm or greater, whichever is employed out of the wall surface member 3 employing a steel sheet of up-down dimension 500 mm and width dimension of 300 mm or the wall surface member 3 employing the steel sheet having an up-down dimension of 700 mm and a width dimension of 433 mm. Moreover, in comparison to the bearing walls in which the ring-shaped ribs 6 are not formed to the wall surface member 3, as in test specimen B1, it is apparent that the bending stress acting at the vicinity of the edge portion 5*a* of the opening portions 5 is distributed more widely in the bearing walls 1 having the ring-shaped ribs 6 formed to the wall surface member 3, as in test specimens B2 to B5, B'2 to B'5.

(3) Relationship Between the Spacing d of Adjacent Opening Portions 5 and Stress Acting on the Wall Surface Member 3

Next, forced displacement was imparted to nine test specimens having different distances d between adjacent opening portions 5, 5, these being C1 to C4 and C'1 to C'5, and the relationship between the distance d between adjacent opening portions 5, 5 and the stress acting on the wall surface member 3 was analyzed.

The distance d between adjacent opening portions 5, 5 for the test specimens C1 to C4 employing the steel sheet of up-down dimension of 500 mm and width dimension of 300 mm, in the sequence of the test specimens C1 to C4, was: 20 mm, 37.5 mm, 75 mm, and 150 mm. Moreover, the distance d between adjacent opening portions 5, 5 for the test specimens C'1 to C'5 employing the steel sheet of up-down dimension of 700 mm and width dimension 433 mm, in the sequence of the test specimens C'1 to C'5, was: 30 mm, 75 mm, 90 mm, 121.5 mm, and 200 mm.

In the test specimens C1 to C4, C'1 to C'5, the radius r of the circular arc portion 61 was 10 mm, the height dimension h of the ring-shaped ribs 6 was 15 mm, the diameter R of the opening portions 5 was 120 mm, and the sheet thickness t of the flat sheet portion 31 was 1.2 mm.

Figure 10A:
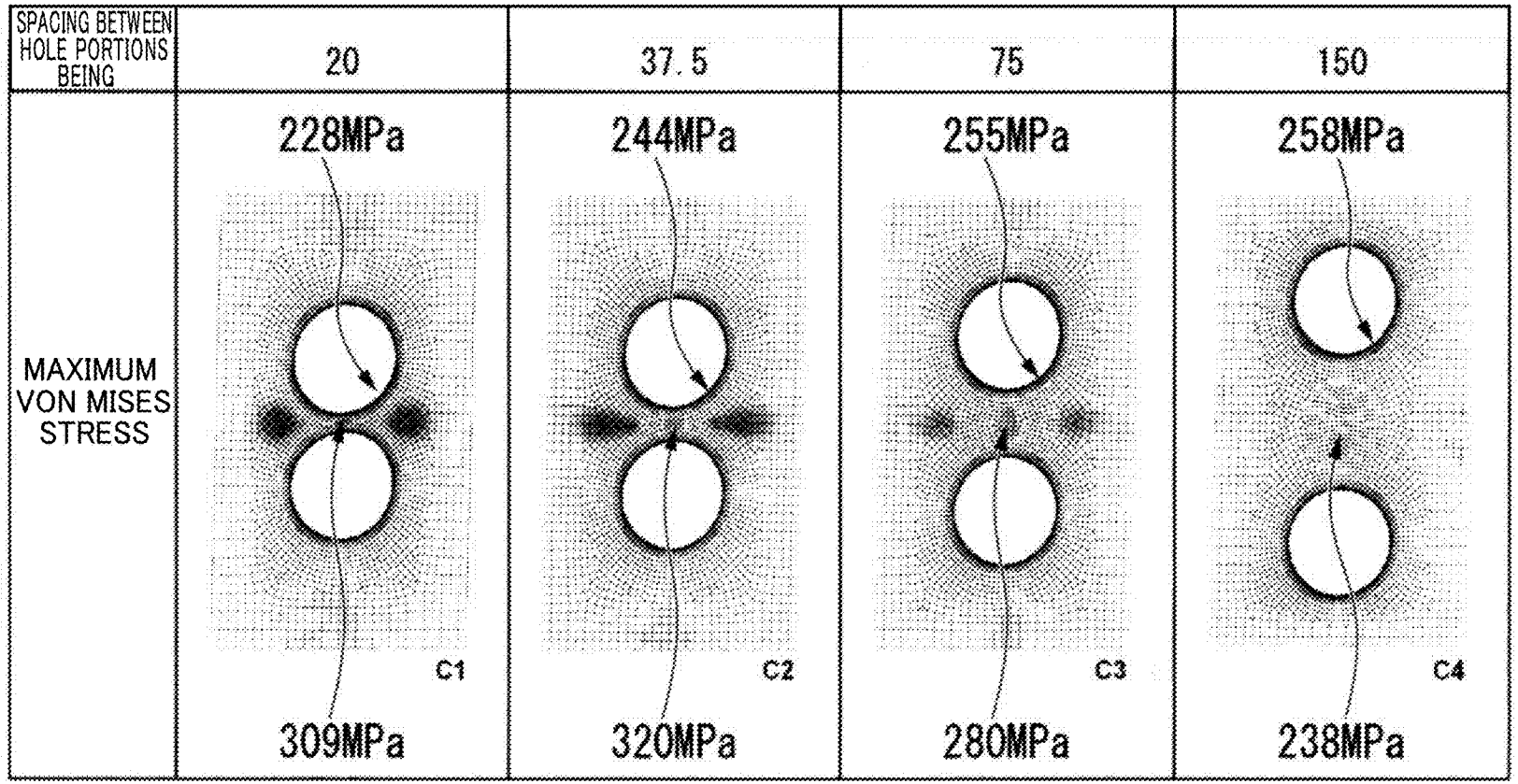
FIG. 10A is a diagram illustrating stress acting on wall surface members having different separation distances between opening portions to each other.
Figure 10B:
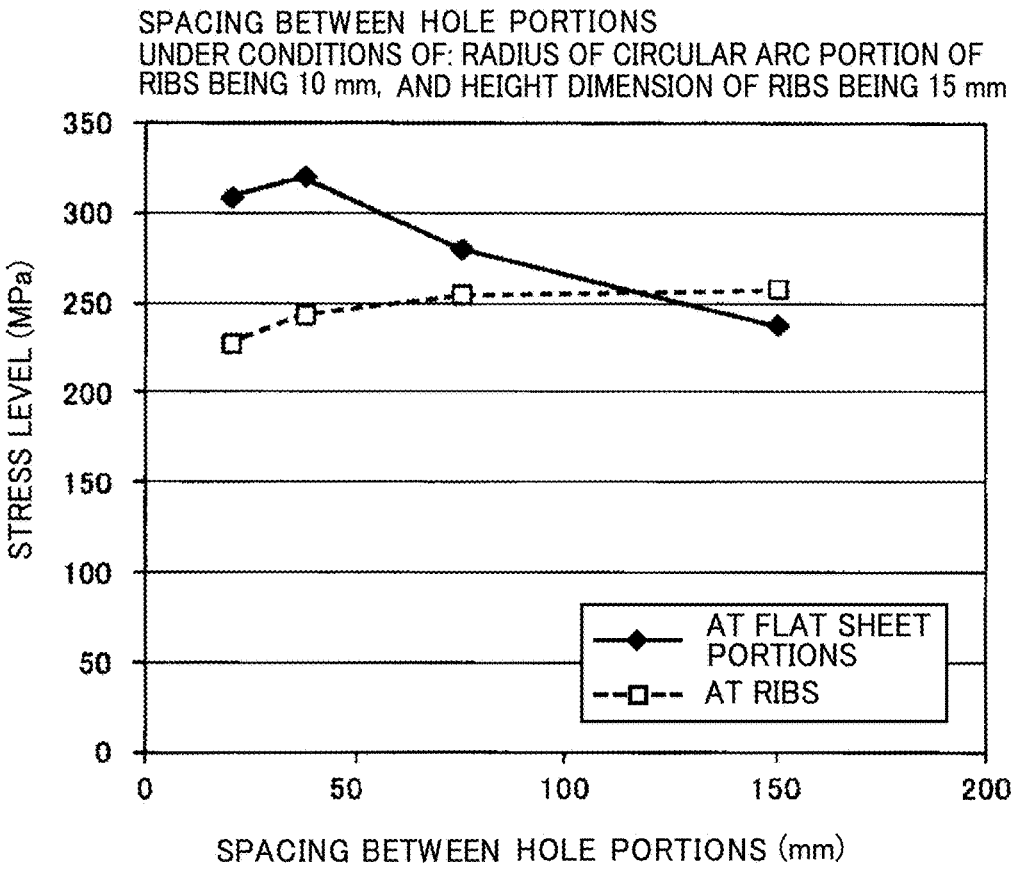
FIG. 10B is a graph illustrating relationships between the separation distance between opening portions and stress acting on wall surface members.

As illustrated in FIG. 10A and FIG. 10B, it is apparent that in the test specimens C1 to C4, employing the steel sheet of up-down dimension of 500 mm and width dimension 300 mm, as the distance d between adjacent opening portions 5, 5 increases, the bending stress acting at the vicinity of the edge portion 5*a* of the opening portions 5 increases (concentrates). There is hardly any change in the shear stress acting on the stress concentration portion 8 in cases in which the distance d between adjacent opening portions 5, 5 is 20 mm or 37.5 mm, however in cases in which the distance d between adjacent opening portions 5, 5 is 37.5 mm or greater, it is apparent that the shear stress acting on the stress concentration portion 8 decreases as the distance d between adjacent opening portions 5, 5 increases, and the shear stress is distributed. It is apparent from FIG. 10B that the maximum von Mises stress acting on the stress concentration portions 8 and the maximum von Mises stress acting at the vicinity of the edge portions 5*a* of the opening portions 5 are the same value when the distance d between adjacent opening portions 5, 5 is about 130 mm. It is also apparent that the maximum von Mises stress acting on the stress concentration portions 8 is greater than the maximum von Mises stress acting at the vicinity of the edge portions 5*a* of the opening portions 5 when the distance d between adjacent opening portions 5, 5 is approximately 130 mm or less. It is accordingly apparent that the distance d between adjacent opening portions 5, 5 is preferably 130 mm or less in test specimens that employ the steel sheet of up-down dimension of 500 mm and width dimension of 300 mm, and in which the radius r of the circular arc portion 61 is 10 mm, the height dimension h of the ring-shaped ribs 6 is 15 mm, the diameter R of the opening portions 5 is 120 mm, and the sheet thickness t of the flat sheet portion 31 is 1.2 mm.

Figure 11B:
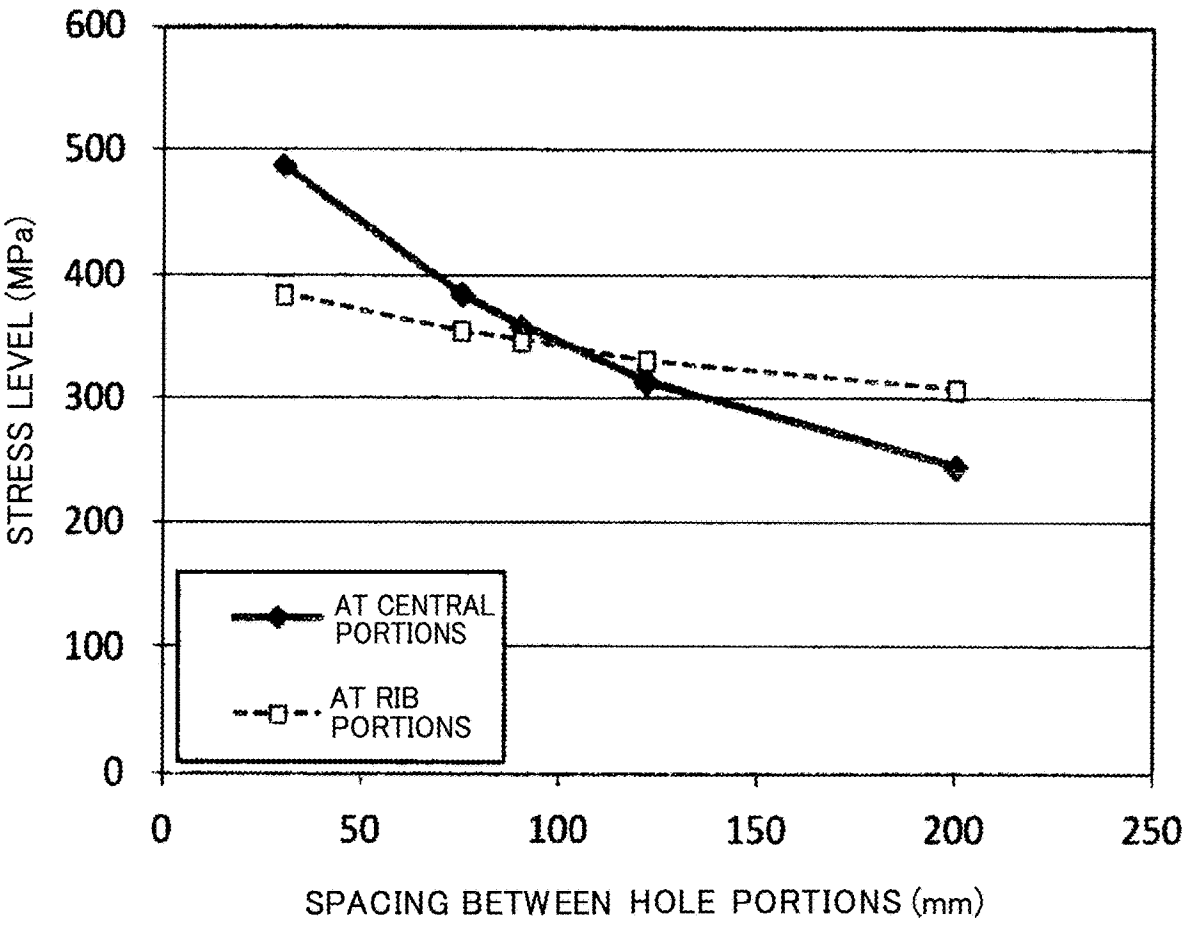
FIG. 11B is a graph illustrating relationships between the separation distance between opening portions and stress acting on wall surface members.

As illustrated in FIG. 11A and FIG. 11B, it is apparent that the bending stress acting at the vicinity of the edge portion 5*a* of the opening portions 5 decreases as the distance d between adjacent opening portions 5, 5 increases in the test specimens C'1 to C'5 employing the steel sheet of up-down dimension of 700 mm and width dimension of 433 mm. Moreover, it is apparent that the shear stress acting on the stress concentration portions 8 decreases as the distance d between adjacent opening portions 5, 5 increases, and the shear stress is distributed. It is also apparent from FIG. 11B that the maximum von Mises stress acting on the stress concentration portions 8 and the maximum von Mises stress acting at the vicinity of the edge portions 5*a* of the opening portions 5 are the same value when the distance d between adjacent opening portions 5, 5 is about 103 mm. Moreover, it is apparent that the maximum von Mises stress acting on the stress concentration portions 8 is greater than the maximum von Mises stress acting at the vicinity of the edge portions 5*a* of the opening portions 5 when the distance d between adjacent opening portions 5, 5 is 103 mm or less. It is accordingly apparent that the distance d between adjacent opening portions 5, 5 is preferably 103 mm or less in test specimens that employ the steel sheet of up-down dimension of 700 mm and width dimension of 433 mm, and in which the radius r of the circular arc portion 61 is 10 mm, the height dimension h of the ring-shaped ribs 6 is 15 mm, the diameter R of the opening portions 5 is 120 mm, and the sheet thickness t of the flat sheet portion 31 is 1.2 mm.

(4) Relationship Between Sheet Thickness t of the Wall Surface Member 3 and Stress Acting on the Wall Surface Member 3

Next, forced displacement was imparted to ten test specimens having different sheet thicknesses t of the wall surface member 3, these being E1 to E5 and E1 to E'5, and the relationship between the sheet thickness t of the wall surface member 3 and the stress acting on the wall surface member 3 was analyzed.

The sheet thickness t of the wall surface member 3 of the test specimens E1 to E5, in the sequence of the test specimens E1 to E5, was: 0.6 mm, 0.8 mm, 1.0 mm, 1.2 mm, and 1.6 mm.

The sheet thickness t of the wall surface member 3 of the test specimens E'1 to E'5, in the sequence of the test specimens E1 to E'5, was: 0.3 mm, 0.6 mm, 0.8 mm, 1.0 mm, and 1.2 mm.

In the test specimens E1 to E5 and E1 to E'5, the radius r of the circular arc portion 61 was 10 mm, the height dimension h of the ring-shaped ribs 6 was 15 mm, the distance d between adjacent opening portions 5, 5 was 75 mm, and the diameter R of the opening portions 5 was 120 mm.

Figure 12A:
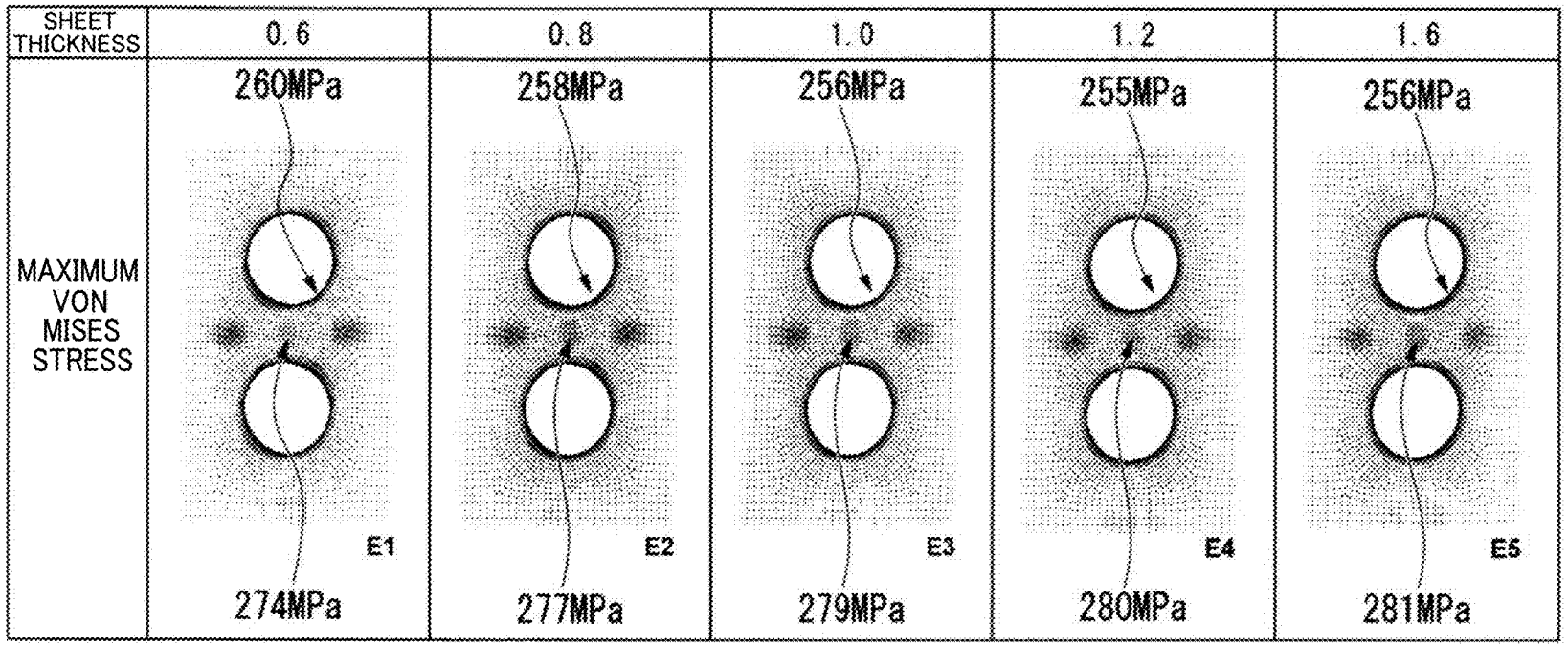
FIG. 12A is a diagram illustrating stress acting on wall surface members having different sheet thickness of wall surface members to each other.
Figure 12B:
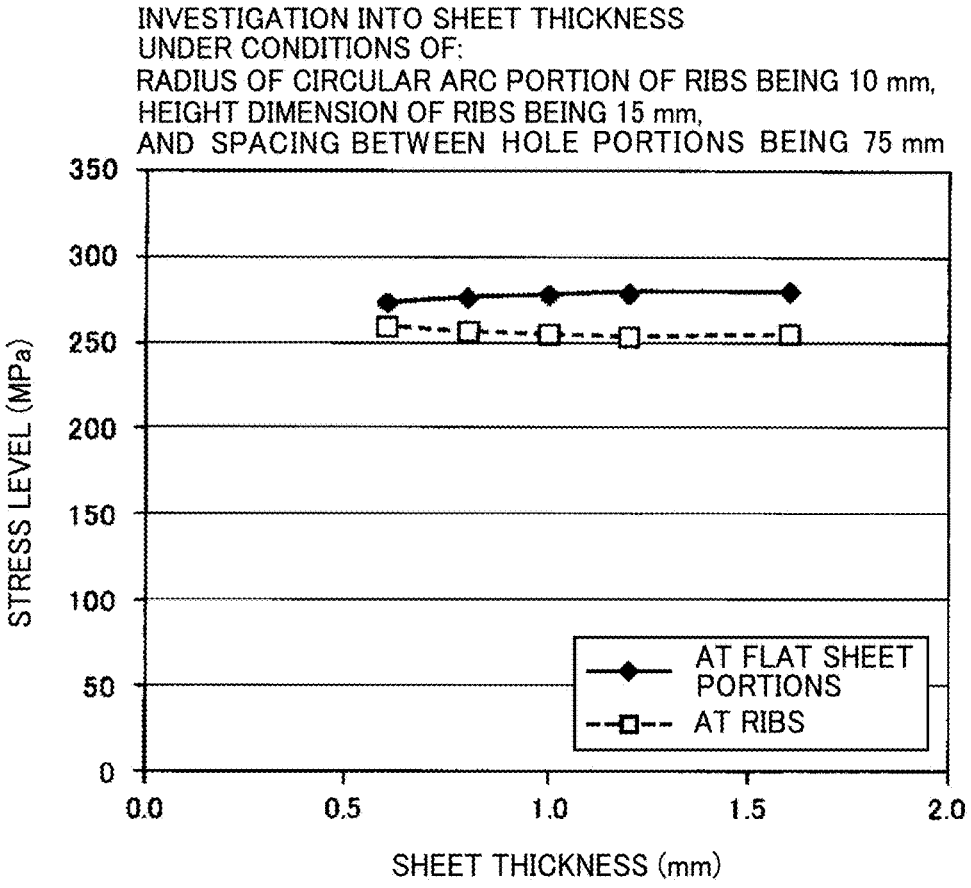
FIG. 12B is a graph illustrating relationships between the sheet thickness of wall surface members and stress acting on wall surface members.

As illustrated in FIG. 12A and FIG. 12B, it is apparent that the shear stress acting on the stress concentration portion 8 increases and the bending stress acting at the vicinity of the edge portion 5*a* of the opening portions 5 decreases and is widely distributed as the sheet thickness t of the wall surface member 3 increases. It is also apparent from FIG. 12B that the value of the maximum von Mises stress acting on the stress concentration portions 8 is greater than the value of the maximum von Mises stress acting at the vicinity of the edge portions 5*a* of the opening portions 5 for each of the sheet thicknesses t of the wall surface member 3. It is accordingly apparent that the sheet thickness of the wall surface member 3 is preferably 0.6 mm or greater for the test specimens employing the steel sheet of up-down dimension of 500 mm and width dimension of 300 mm, and in which the radius r of the circular arc portion 61 is 10 mm, the height dimension h of the ring-shaped ribs 6 is 15 mm, the distance d between adjacent opening portions 5, 5 is 75 mm, and the diameter R of the opening portions 5 is 120 mm.

Figure 13A:
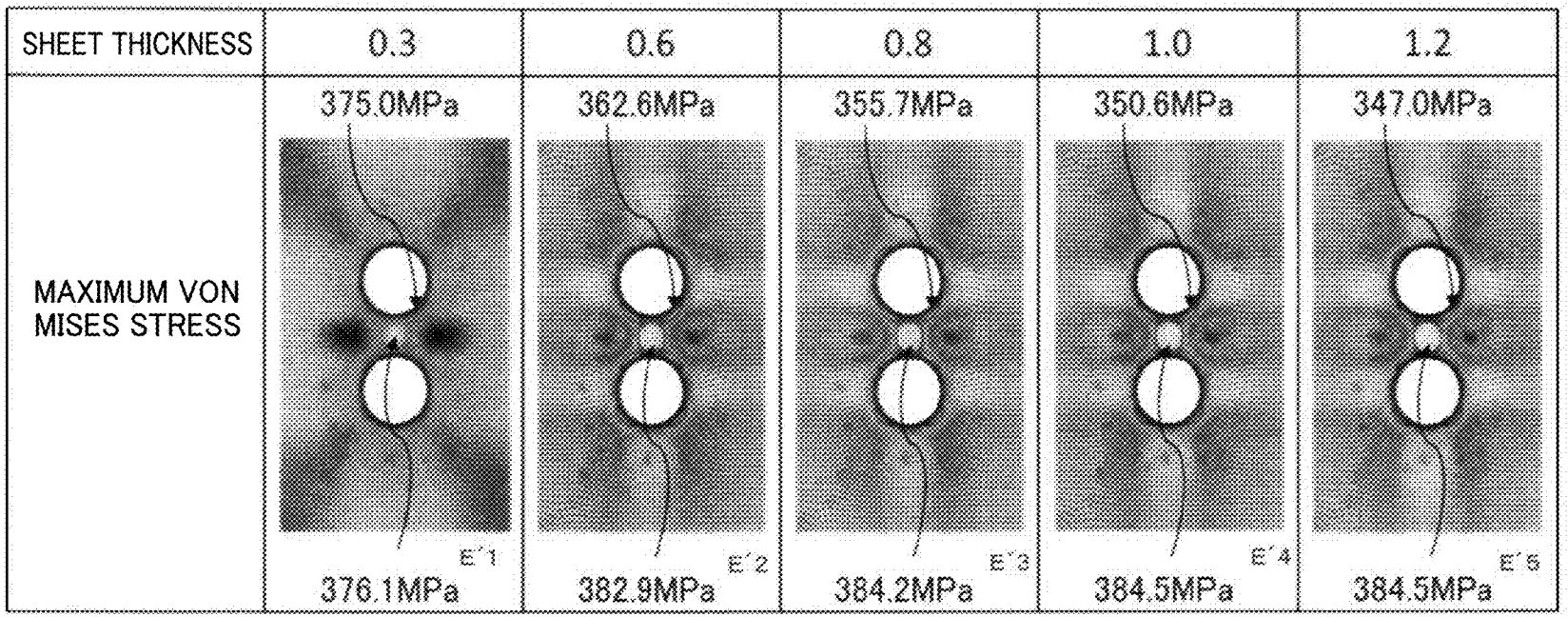
FIG. 13A is a diagram illustrating stress acting on wall surface members having different sheet thickness of wall surface members to each other.
Figure 13B:
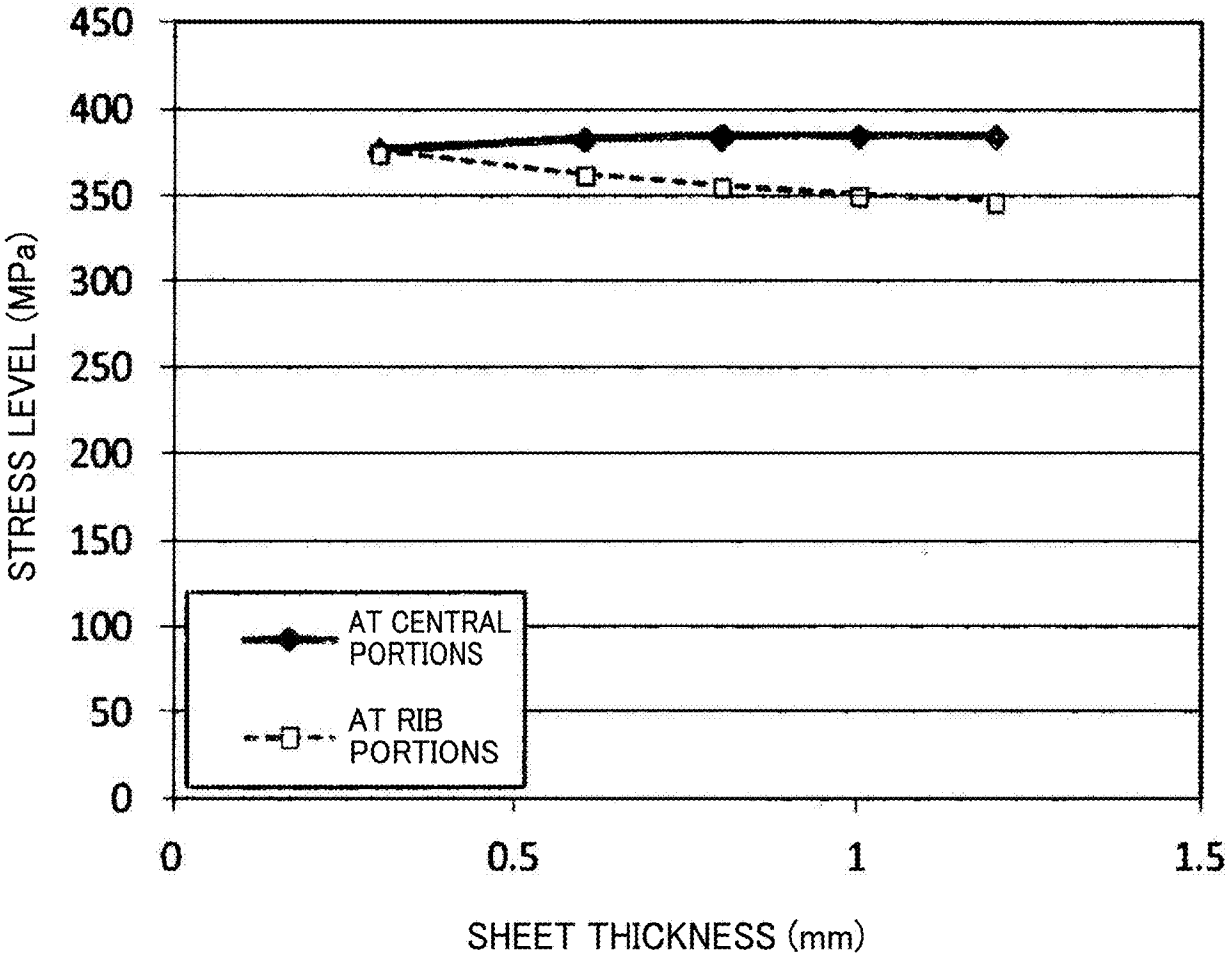
FIG. 13B is a graph illustrating relationships between the sheet thickness of wall surface members and stress acting on wall surface members.

As illustrated in FIG. 13A and FIG. 13B, the shear stress acting on the stress concentration portion 8 increases as the sheet thickness t increases over the range 0.6 mm to 0.8 mm for the sheet thickness t of the wall surface member 3, however, there is hardly any change in the shear stress acting on the stress concentration portion 8 even if the sheet thickness t is made thicker when the sheet thickness t of the wall surface member 3 is already in a range exceeding 0.8 mm. Moreover, it is also apparent that the bending stress acting at the vicinity of the edge portion 5*a* of the opening portions 5 decreases and is widely distributed as the sheet thickness t of the wall surface member 3 increases. It is also apparent from FIG. 13B that the value of the maximum von Mises stress acting on the stress concentration portions 8 is greater than the value of the maximum von Mises stress acting at the vicinity of the edge portions 5*a* of the opening portions 5 when the sheet thicknesses t of the wall surface member 3 is 0.3 mm or greater. It is accordingly apparent that the sheet thickness of the wall surface member 3 is preferably 0.3 mm or greater for the test specimens employing the steel sheet of up-down dimension of 700 mm and width dimension of 433 mm, and in which the radius r of the circular arc portion 61 is 10 mm, the height dimension h of the ring-shaped ribs 6 is 15 mm, the distance d between adjacent opening portions 5, 5 is 75 mm, and the diameter R of the opening portions 5 is 120 mm.

(5) Relationship Between the Diameter R of the Opening Portions 5 and the Stress Acting on the Wall Surface Member 3

Next, forced displacement was imparted to five test specimens having different diameters R of the opening portions 5, these being test specimens D1 to D5, and the relationship between the diameter R of the opening portions 5 and the stress acting on the wall surface member 3 was analyzed.

The diameter R of the opening portions 5 of the test specimens D1 to D5, in the sequence of the test specimens D1 to D5, was: 40 mm, 80 mm, 120 mm, 160 mm, and 200 mm.

With the test specimens D1 to D5, the radius r of the circular arc portion 61 was 10 mm, the height dimension h of the ring-shaped ribs 6 was 15 mm, the distance d between adjacent opening portions 5, 5 was 75 mm, and the sheet thickness t of the flat sheet portion 31 was 1.2 mm.

Figure 14A:
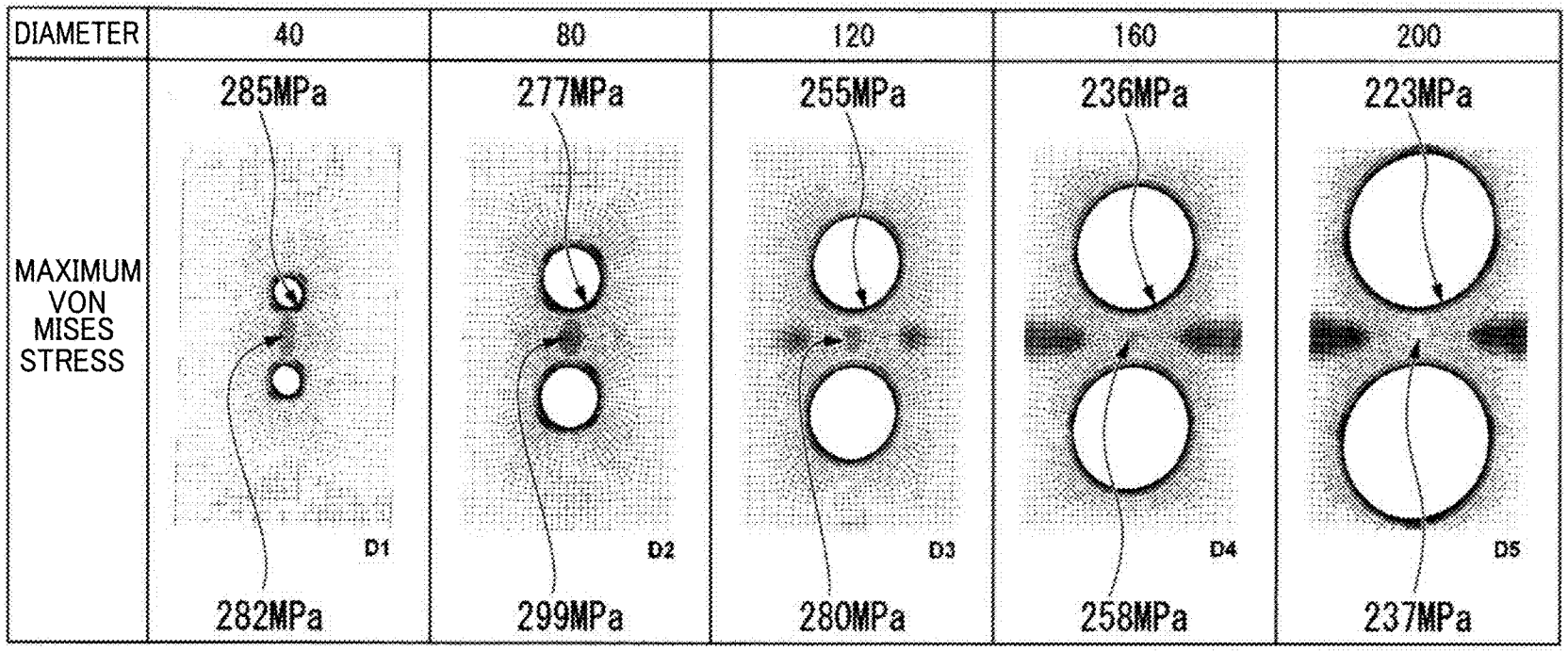
FIG. 14A is a diagram illustrating stress acting on wall surface members having different diameter opening portions to each other.
Figure 14B:
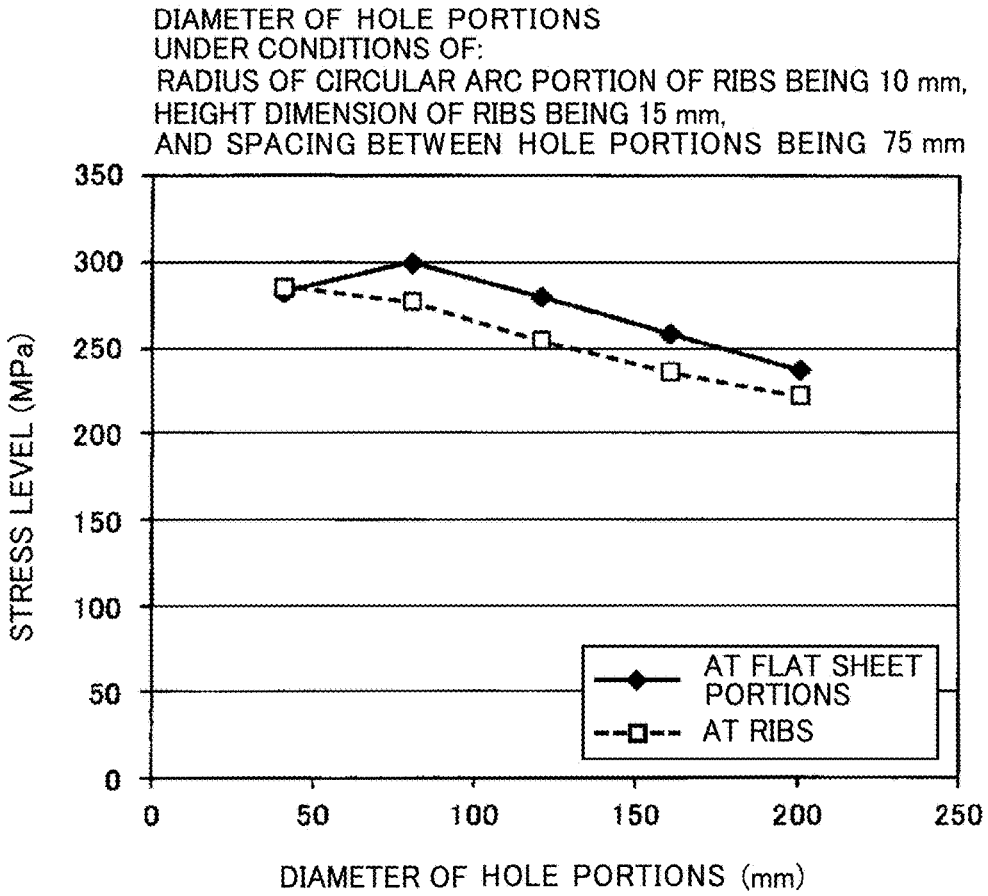
FIG. 14B is a graph illustrating relationships between the diameter of opening and stress acting on wall surface members.

As illustrated in FIG. 14A and FIG. 14B, the bending stress acting at the vicinity of the edge portion 5*a* of the opening portions 5 decreases and is widely distributed as the diameter R of the opening portions 5 increases. In cases in which the diameter R of the opening portions 5 was 40 mm or 80 mm, the shear stress acting on the stress concentration portion 8 was greater for 80 mm; however, the shear stress acting on the stress concentration portion 8 decreased as the diameter R of the opening portions 5 increased for diameters R of the opening portions 5 of 80 mm or greater. It is also apparent from FIG. 14B that the maximum von Mises stress acting on the stress concentration portions 8 and the maximum von Mises stress acting at the vicinity of the edge portions 5*a* of the opening portions 5 are the same value when the diameter R of the opening portions 5 is about 40 mm. Moreover, it is apparent that the maximum von Mises stress acting on the stress concentration portions 8 was greater than the maximum von Mises stress acting at the vicinity of the edge portions 5*a* of the opening portions 5 when the diameter R of the opening portions 5 is about 50 mm or greater. It is accordingly apparent that the diameter of the opening portions 5 is preferably 50 mm or greater for the test specimens employing the steel sheet of up-down dimension of 500 mm and width dimension of 300 mm, and in which the radius r of the circular arc portion 61 is 10 mm, the height dimension h of the ring-shaped ribs 6 is 15 mm, the distance d between adjacent opening portions 5, 5 is 75 mm, and the sheet thickness t of the flat sheet portion 31 is 1.2 mm. Note that due to the shear stress acting on the stress concentration portion 8 decreasing as the diameter R of the opening portions 5 increases when the diameter R of the opening portions 5 is 80 mm or greater, in actual design, the diameter R of the opening portions 5 is set so as to make the shear stress acting on the stress concentration portion 8 a required value or greater.

According to the results of the analysis described above, it is apparent that the maximum von Mises stress occurring in the ring-shaped ribs 6 may be adjusted so as to be lower than the maximum von Mises stress occurring at locations of the wall surface member 3 between one opening portion 5 and another opening portion 5 adjacent in the up-down direction (at the stress concentration portions 8) by adjusting any one of the profile of the ring-shaped ribs 6, the height of the ring-shaped ribs 6 with respect to the flat sheet portion 31, the internal diameter of the opening portions 5, the distance between the center of one opening portion 5 and the center of the other opening portion 5 adjacent in the up-down direction, or the thickness of the wall surface member 3.

(6-1) Comparison Between the Von Mises Stress Occurring Between Adjacent Opening Portions 5, 5 (at the Stress Concentration Portions 8), and Between the Opening Portions 5 and the First Joint Portions 4*a*

Figure 15:
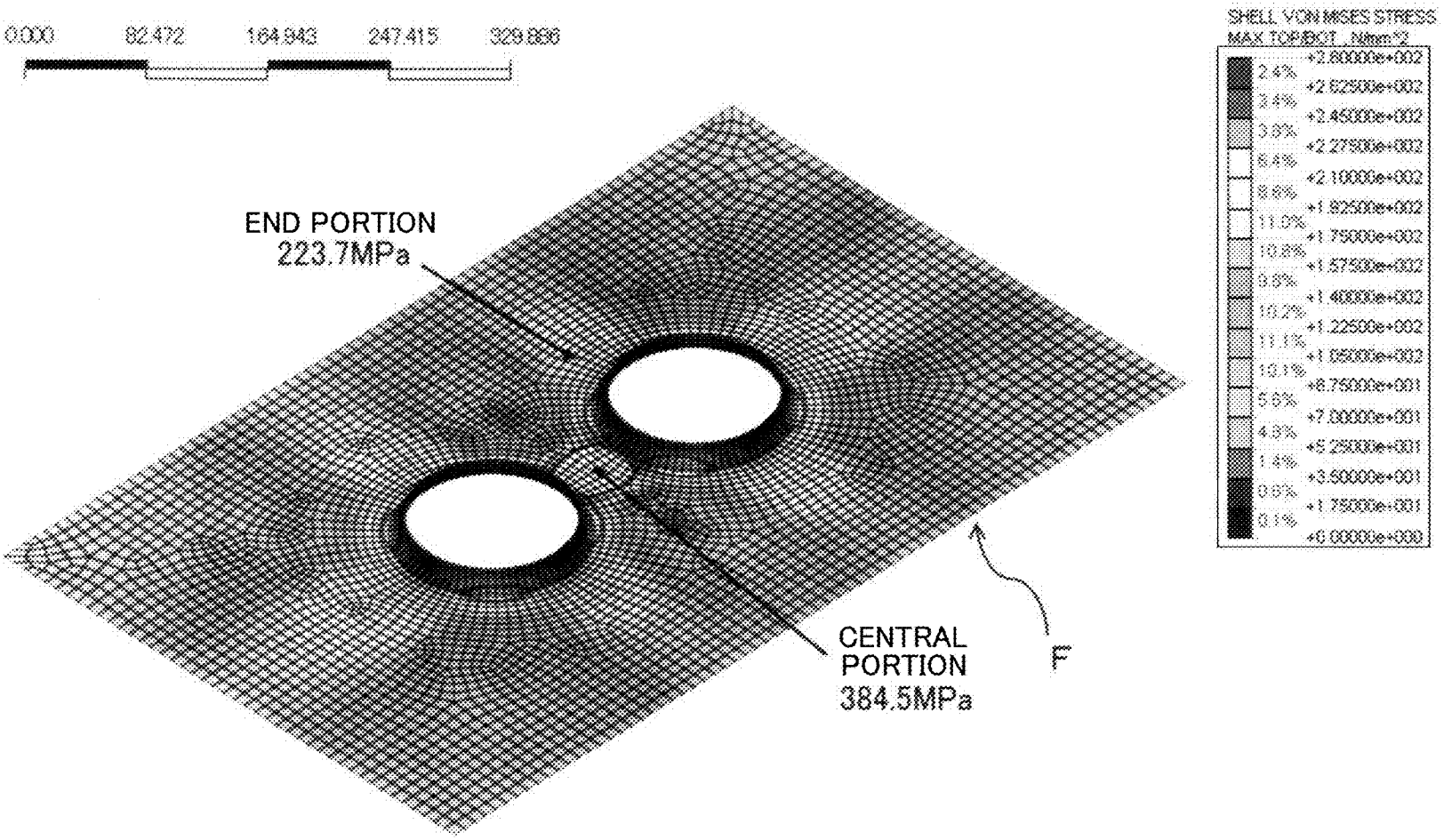
FIG. 15 is a diagram illustrating stress acting on a wall surface member.

As illustrated in FIG. 15, similar analysis to that described above was performed by applying a forced displacement, of $\delta X=0.8876$ mm, to a test specimen F of a bearing wall 1 configured by employing a wall surface member 3 having an up-down dimension H=700 mm and a width dimension W=433 mm, and the von Mises stresses occurring between adjacent opening portions 5, 5 (at the stress concentration portions 8), and between the opening portions 5 and the first joint portions 4*a*, were compared.

The test specimen F is set with a diameter of the opening portions 5, 5 Φ=120 mm, a rib height H=15 mm, a rib circular arc portion radius R=10 mm, a distance between adjacent opening portions 5, 5 d=75 mm, with a horizontal distance between the opening portions 5 and the first joint portions 4*a* D3=156.5 mm, and with a horizontal distance between the opening portions 5 and the second joint portions 4*b* D4=156.5 mm. Namely, a distance D1 between the central axes 5*b*, 5*b* of the opening portions 5, 5 adjacent in the up-down direction is set so as to be shorter than a distance D2 between the joints between the pair of vertical members 2*a*, 2*b* and the wall surface member 3 (the horizontal distance D2 between the first joint portions 4*a* and the second joint portions 4*b*). In other words, the distance d equivalent to between adjacent opening portions 5, 5 is set so as to be shorter than the sum of the horizontal distance D3 between the opening portions 5 and the first joint portions 4*a* and the horizontal distance D4 between the opening portions 5 and the second joint portions 4*b*.

In the analysis of the test specimen F, the maximum von Mises stress between the adjacent opening portions 5, 5 was 348.5 MPa, and the maximum von Mises stress between the opening portions 5 and the first joint portions 4*a* was 223.7 MPa. Namely, the von Mises stress occurring between the opening portions 5 and the first joint portions 4*a* decreased to less than the von Mises stress occurring between the adjacent opening portions 5, 5. This thereby enables deformation between the opening portions 5 and the first joint portions 4*a* to be suppressed when earthquake load acts on the bearing wall 1, and by making deformation occur between the adjacent opening portions 5, 5 (at the stress concentration portions 8) before deformation between the opening portions 5 and the first joint portions 4*a*, the energy from the earthquake can be stabilized and absorbed.

(6-2) Comparison Between the Von Mises Stresses Occurring Between Adjacent Opening Portions 5, 5 (at the Stress Concentration Portions 8) and Between the Opening Portions 5 and the First Joint Portions 4*a*

Figure 16A:
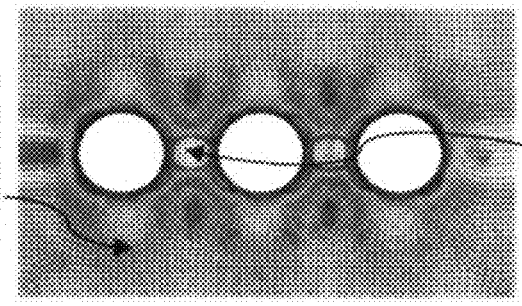
FIG. 16A is a diagram illustrating stress acting on wall surface members having different numbers of columns of opening portions to each other.
Figure 16A:
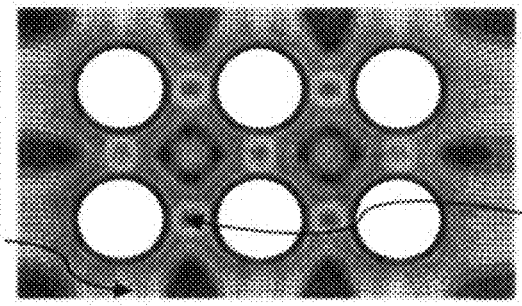

As illustrated in FIG. 16A, forced displacement, of δX=0.850 mm, was imparted in analysis similar to that described above employing test specimens G1, G2 of a bearing wall 1 configured using a wall surface member 3 having an up-down dimension H=700 mm and a width dimension W=433 mm, and the von Mises stresses occurring between adjacent opening portions 5, 5 (at the stress concentration portions 8), and between the opening portions 5 and the first joint portions 4*a* were compared.

In the test specimen G1, three opening portions 5 were disposed in a column with a spacing apart in the up-down direction, and the diameter Φ of the opening portions 5 was set at 120 mm, the rib height H was set at 15 mm, the rib circular arc portion radius R was set at 10 mm, and the distance d between adjacent opening portions 5, 5 in the up-down direction was set at 75 mm.

In the test specimen G2, three opening portions 5 disposed so as to have a spacing apart in the up-down direction, were disposed in two columns spaced apart in the horizontal direction, and the diameter Φ of the opening portions 5 was set at 120 mm, the rib height H was set at 15 mm, the rib circular arc portion radius R was set at 10 mm, the distance d between adjacent opening portions 5, 5 in the up-down direction was set at 75 mm, and the distance d between adjacent opening portions 5, 5 in the horizontal direction was set at 75 mm.

Figure 16B:
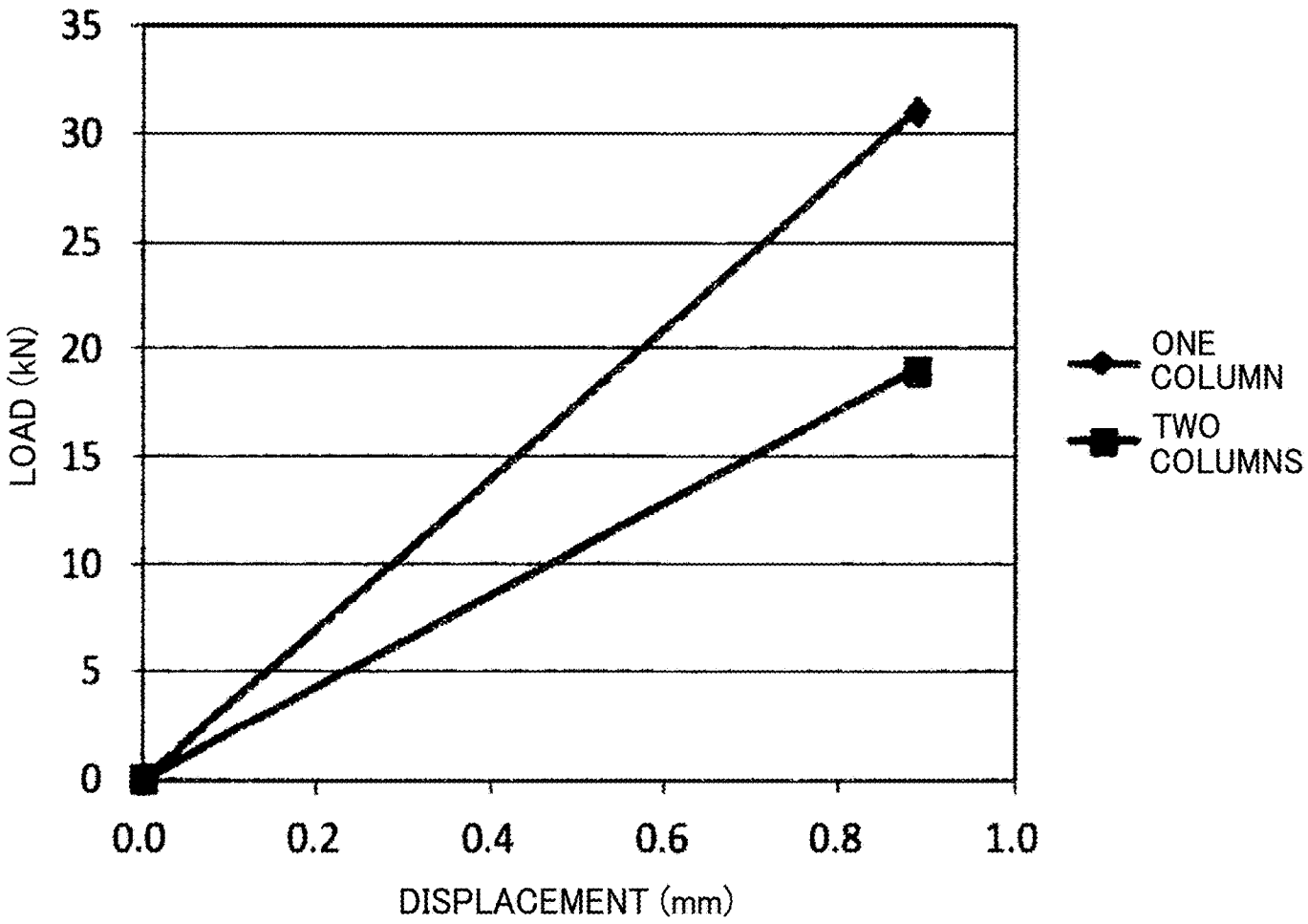
FIG. 16B is a graph illustrating relationships between the load input to wall surface members and displacement.

As illustrated in FIG. 16A, it is apparent that in the test specimen G1 and the test specimen G2 the von Mises stress occurring between the opening portions 5 and the first joint portions 4*a* was reduced to less than the von Mises stress occurring between the adjacent opening portions 5, 5 in the up-down direction. However, as illustrated in FIG. 16B, it is apparent that the test specimen G2 is displaced by 0.850 mm by a load of less than that of the test specimen G1. Namely, it is apparent that the test specimen G2 has a lower shear modulus than that of the test specimen G1. It is therefore apparent from the result of this analysis that for a bearing wall 1 having a desired shear modulus, employing the wall surface member 3 formed with the single column of opening portions is more appropriate than employing the wall surface member 3 formed with plural columns of the opening portions 5 along the horizontal direction.

(6-3) Comparison Between the Von Mises Stresses Occurring Between the Adjacent Opening Portions 5, 5 (at the Stress Concentration Portions 8) and Occurring Between the Opening Portions 5 and the First Joint Portions 4*a*

Figure 17A:
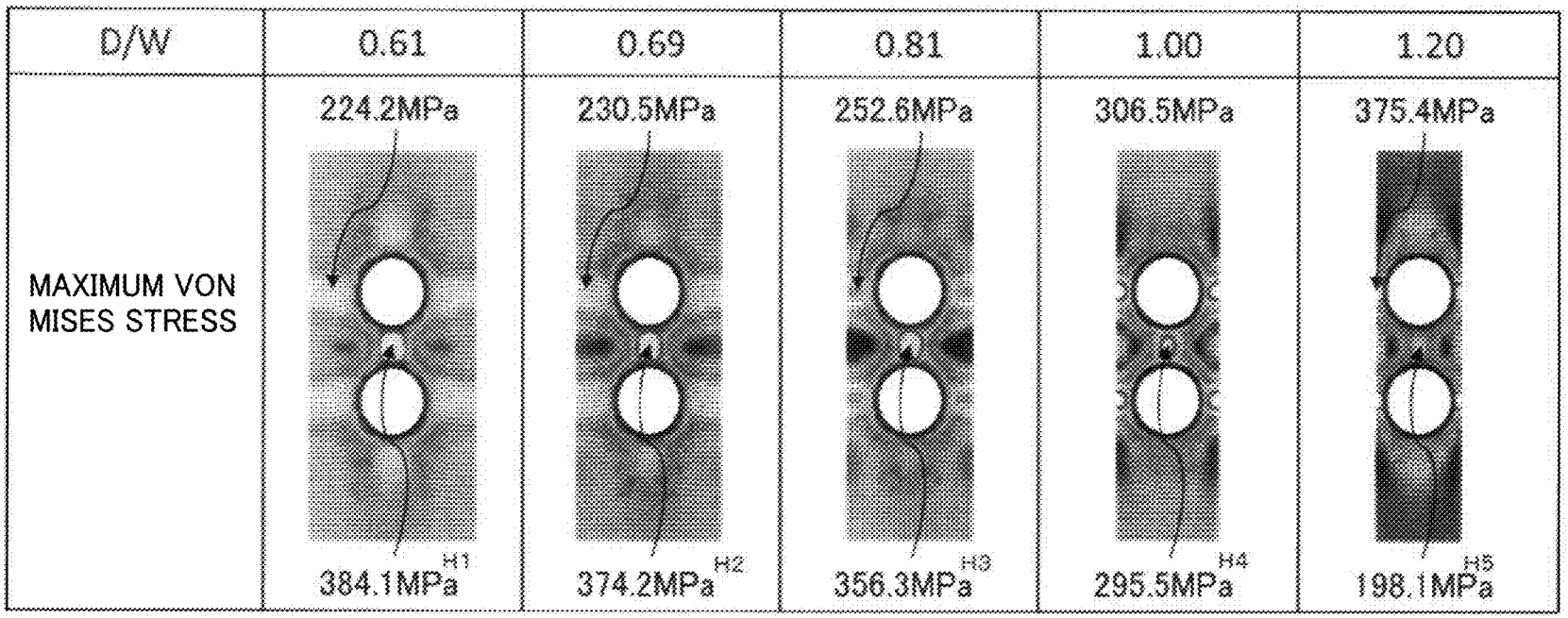
FIG. 17A is a diagram illustrating stress acting on wall surface members with different D1/D2 to each other.

As illustrated in FIG. 17A, similar analysis to that described above was performed by applying a forced displacement, of δX=0.8876 mm, to test specimens H1 to H5 of a bearing wall 1 configured by employing a wall surface member 3 having an up-down dimension H=700 mm and a width dimension W=433 mm, and the von Mises stresses occurring between adjacent opening portions 5, 5 (at the stress concentration portions 8), and between the opening portions 5 and the first joint portions 4*a* were compared.

In the test specimens H1 to H5, two opening portions 5 with a spacing apart in the up-down direction are disposed in one column, and the diameter Φ of the opening portions 5 was set at 120 mm, the rib height H was set at 15 mm, the rib circular arc portion radius R was set at 10 mm, and the center separation distance D1 between adjacent opening portions 5, 5 was set at 195 mm.

In the test specimens H1 to H5, the ratios of the center separation distance D1 between adjacent opening portions 5, 5 to the horizontal separation distance D2 between the first joint portions 4*a* and the second joint portions 4*b* (hereinafter simply referred to as "D1/D2"), in the sequence of the test specimens H1 to H5, was: 0.61, 0.69, 0.81, 1.00, and 1.20.

Figure 17B:
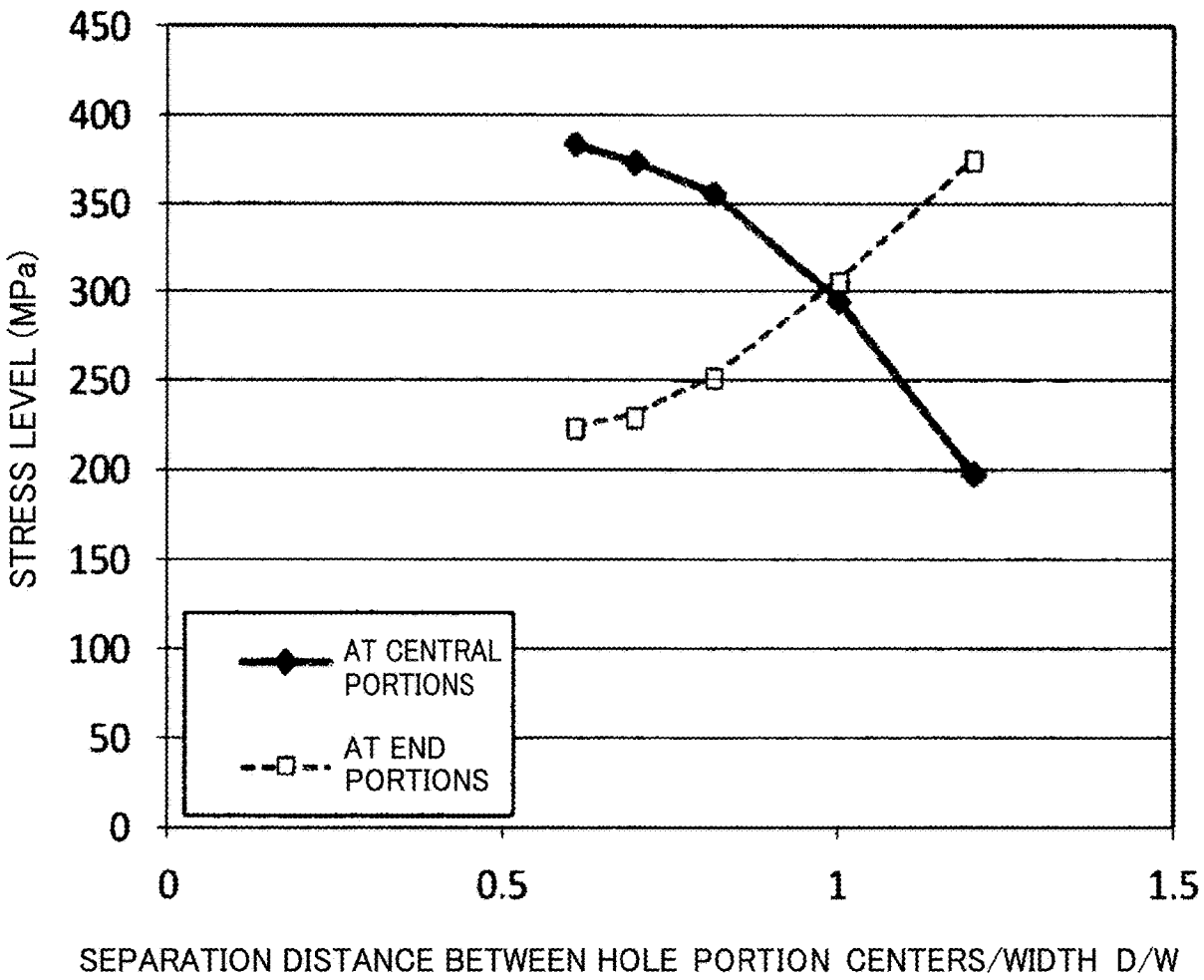
FIG. 17B is a graph illustrating relationships between D1/D2 and stress acting on wall surface members.

As illustrated in FIG. 17B, in a region in which D1/D2 is less than 1.0, the von Mises stress occurring between the opening portions 5 and the first joint portions 4*a* is lower than the von Mises stress occurring between the opening portions 5, 5 adjacent in the up-down direction. In a region in which D1/D2 is 1.0 or greater, the von Mises stress occurring between the opening portions 5 and the first joint portions 4*a* is higher than the von Mises stress occurring between the opening portions 5, 5 adjacent in the up-down direction. As a result of the analysis described above, it is apparent that D1/D2 should preferably be set so as to be less than 1.0, namely, should preferably be set such that the center separation distance between adjacent opening portions 5, 5 is shorter than the horizontal separation distance D2 between the first joint portions 4*a* and the second joint portions 4*b*.

Third Exemplary Embodiment

Next, explanation follows regarding a bearing wall according to a third exemplary embodiment, with reference to the appended drawings.

Figure 18A:
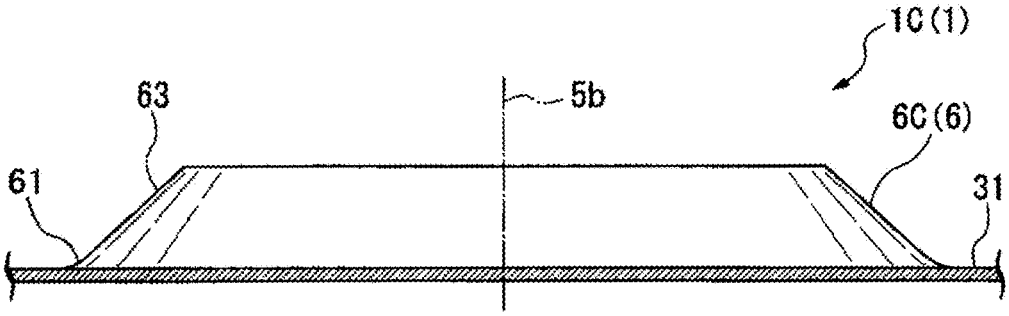
FIG. 18A is a side view of a ring-shaped rib formed to a wall surface member of a bearing wall according to a third exemplary embodiment.
Figure 18B:
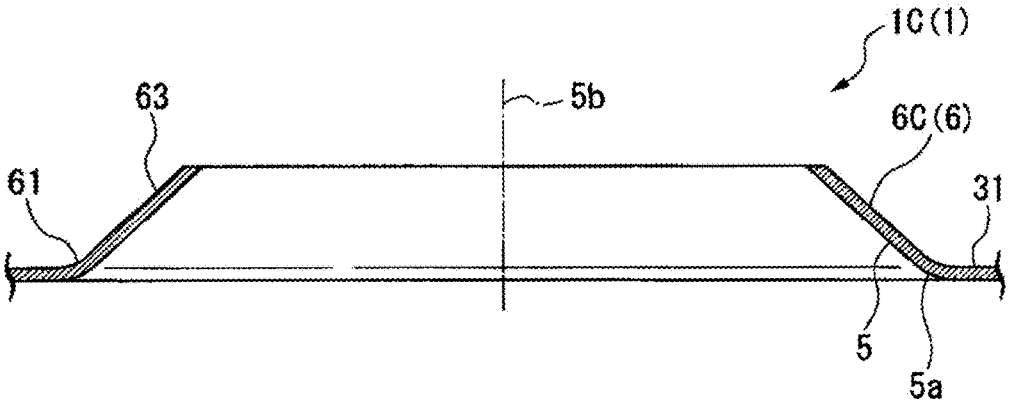
FIG. 18B is a cross-section of the ring-shaped rib illustrated in FIG. 18A.

As illustrated in FIG. 18A and FIG. 18B, in a bearing wall 1C (1) according to the third exemplary embodiment, in place of the straight line portion 62 of the ring-shaped ribs 6 in the second exemplary embodiment, sloping portions 63, having a straight line sloping profile that slopes toward central axes 5*b* of the opening portions 5 on progression away from the flat sheet portion 31 in a cross-section taken along the radial direction of the opening portions 5, are formed to the leading end portion 6*b* side of ring-shaped ribs 6C (6).

In the bearing wall 1C according to the third exemplary embodiment, the sloping portions 63 and the circular arc portions 61 distribute the bending stress acting at the vicinity of the edge portion 5*a* of the opening portions 5, and therefore similar operation and advantageous effects are exhibited to those of the first exemplary embodiment.

Fourth Exemplary Embodiment

Next, explanation follows regarding a bearing wall according to the fourth exemplary embodiment.

Figure 19A:
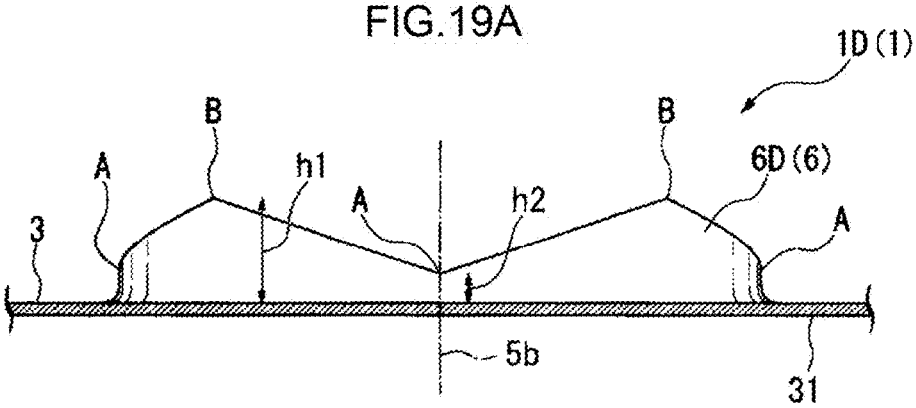
FIG. 19A is a side view of a ring-shaped rib formed to a wall surface member of a bearing wall according to a fourth exemplary embodiment.
Figure 19B:
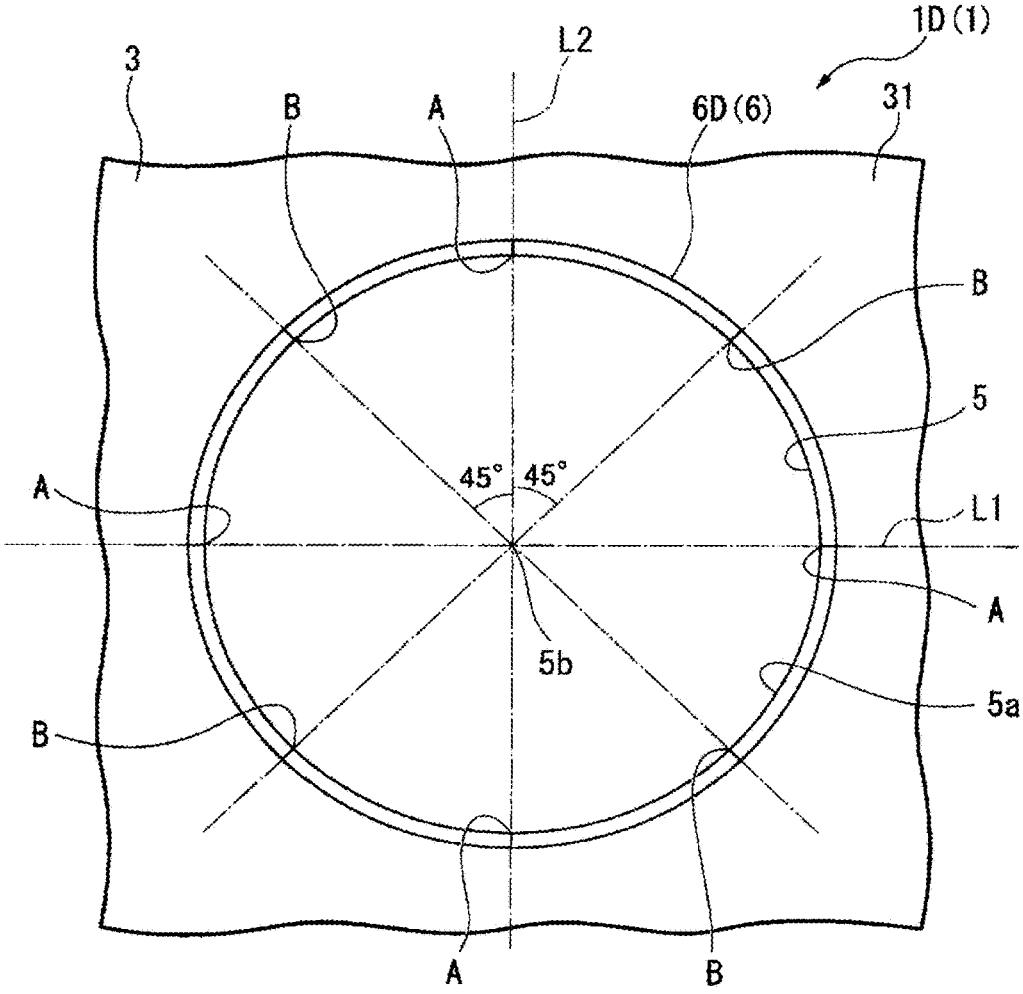
FIG. 19B is a face-on view of the ring-shaped rib illustrated in FIG. 19A.

As illustrated in FIG. 19A and FIG. 19B, a bearing wall 1D (1) according to the fourth exemplary embodiment has the feature of the height dimension of ring-shaped ribs 6D (6) varying according to location. The circular arc portion 61 here is formed with a cross-section profile of a quarter circle, and the height dimensions of the circular arc portion 61, and of the straight line portion 62 contiguous thereto, differ by section.

As illustrated in FIG. 19B, the present exemplary embodiment has a feature in which the height with respect to the flat sheet portion 31 of the ring-shaped ribs 6 at a position offset by 45° in the circumferential direction of the opening portion 5, with respect to a bisecting line L1 that bisects the opening portions 5 in the up-down direction or with respect to a bisecting line L2 that bisects the opening portions 5 in the horizontal direction, is greater than the height with respect to the flat sheet portion 31 of the ring-shaped ribs 6 on the bisecting line L1, L2. More specifically, in the ring-shaped ribs 6, the four sections that overlap with the vertical line L1 and the horizontal line L2 intersecting at the central axes 5*b* of the opening portions 5 within the plane direction of the wall surface member 3 are referred to as sections A, A, A, A, and the four sections offset from the portions A, A, A, A by 45° in the circumferential direction of the opening portions 5 are referred to as sections B, B, B, B, and the height dimension h1 of the ring-shaped ribs 6 at the sections A is 5 mm, and the height dimension h2 of the ring-shaped ribs 6 at the sections B is 20 mm: greater than at other sections. The vicinity of the points B are sections where the bending stress is liable to concentrate under the action of earthquake load.

In the bearing wall 1D according to the fourth exemplary embodiment, due to the height dimension h2 of the ring-shaped ribs 6D at the sections where bending stress is liable to concentrate out of the edge portions 5*a* of the opening portions 5 (in the vicinity of the points B) being formed so as to be greater than at other sections, the bending stress acting at the vicinity of the edge portion 5*a* of the opening portions 5 can be efficiently distributed by the ring-shaped ribs 6D.

In the exemplary embodiments described above, the pair of vertical members 2*a*, 2*b* are provided so as to extend along the length direction Y spaced apart in the horizontal direction (the width direction X), however, the pair of vertical members 2*a*, 2*b* may be connected together by a connecting member or the like. Moreover, a configuration may be adopted in which top end portions and bottom end portions of the pair of vertical members 2*a*, 2*b* are connected together so as to configure a rectangular shaped frame as viewed face-on.

In the exemplary embodiments described above, the joint portions 4 between the pair of vertical members 2*a*, 2*b* and the wall surface member 3 are screw joints, however, joints other than screw joints may be employed.

In the fourth exemplary embodiment described above, the height dimension of the straight line portions 62 of the ring-shaped ribs 6 differs by section, however, the height dimension of both the circular arc portions 61 and the straight line portions 62 may differ by section, or the height dimension of the circular arc portions 61 alone may differ by section. A profile may be formed in which the height dimension differs by section for ring-shaped ribs 6 including the circular arc portions 61 alone, and not formed with the straight line portions 62.

Fifth Exemplary Embodiment

Next, explanation follows regarding a bearing wall according to a fifth exemplary embodiment, and to a building configured by employing the bearing wall, with reference to FIG. 20 to FIG. 24.

Figure 20:
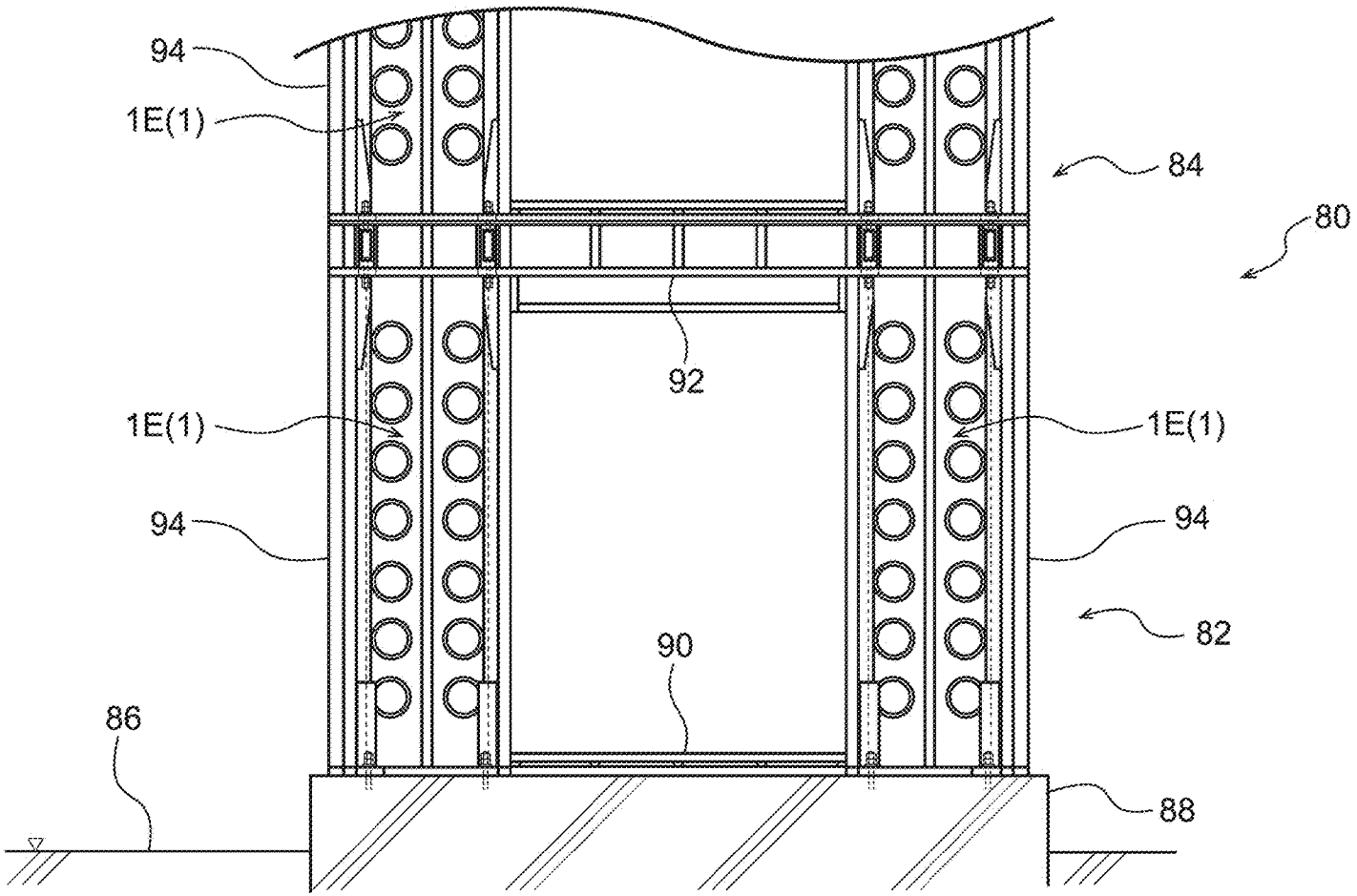
FIG. 20 is a side elevation illustrating a building employing a bearing wall according to a fifth exemplary embodiment.

As illustrated in FIG. 20, the bearing wall 1E (1) of the present exemplary embodiment is employed in a four story building 80. FIG. 20 illustrates a portion of a first story section 82 and second story section 84 of the building 80.

As illustrated in FIG. 20, a foundation 88 is built into the ground surface 86. A lower frame 90 is fixed to the upper face of the foundation 88, and vertical members 94 are installed extending up from the lower frame 90. A frame of the first story section 82 is configured by installing an upper member 92 so as to span across between the vertical members 94. Vertical members 94 are also installed so as to extend up from the lower frame 90 of the second story section 84, and a frame of the second story section 84 is configured by installing an upper frame, not illustrated in the drawings, so as to span across between the vertical members 94. The frames of the third story section and of the fourth story section, not illustrated in the drawings, are configured substantially the same as the frame of the second story section 84.

Bearing walls 1, that are an essential element of the present exemplary embodiment, are fixed to both horizontal direction end portions of the first story section 82 and of the second story section 84. Explanation follows regarding details of the configuration of the bearing wall 1.

Figure 21:
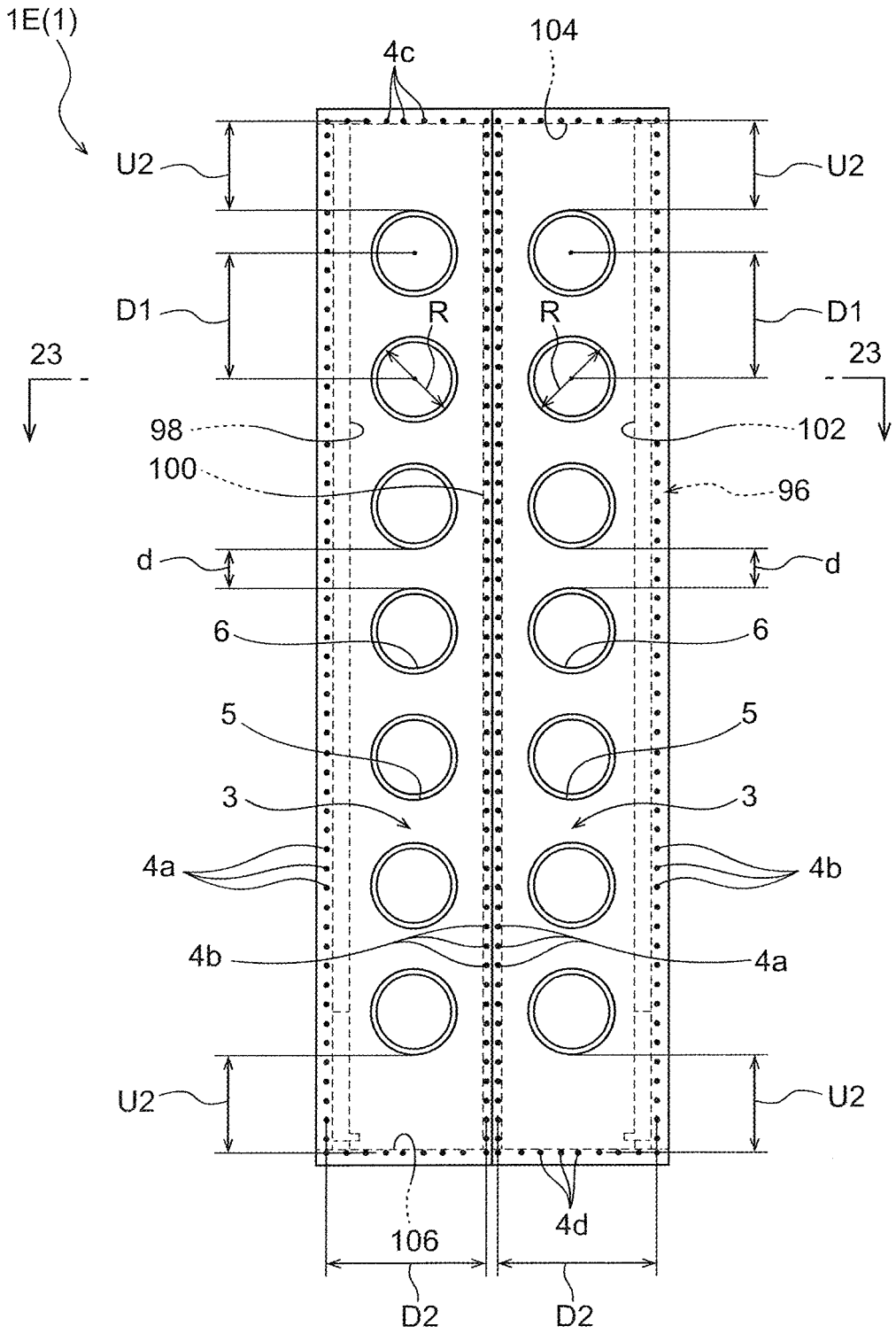
FIG. 21 is a side elevation illustrating a bearing wall according to the fifth exemplary embodiment.

As illustrated in FIG. 21, the bearing wall 1 is configured including a frame member 96 formed in a rectangular shape, and two panels of wall surface member 3 attached to the vertical members 94.

Figure 22:
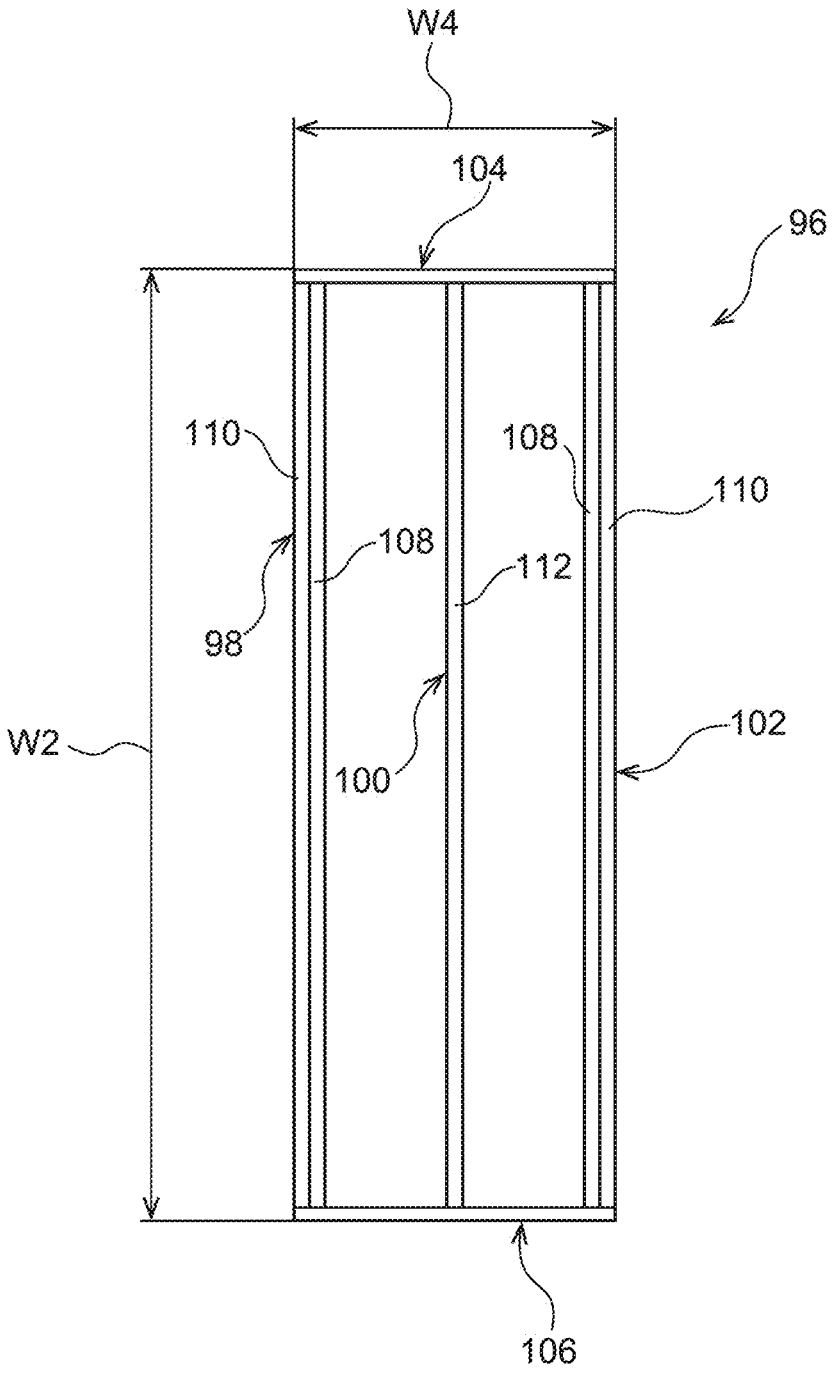
FIG. 22 is a side elevation illustrating a frame of the bearing wall illustrated in FIG. 21.

As illustrated in FIG. 22, the frame member 96 includes a first vertical member 98, a second vertical member 100, and a third vertical member 102 that are disposed spaced apart from each other in the horizontal direction, an upper frame 104 that connects the top ends of the first vertical member 98, the second vertical member 100, and the third vertical member 102 together along the horizontal direction, and a lower frame 106 that connects the bottom ends of the first vertical member 98, the second vertical member 100, and the third vertical member 102 together along the horizontal direction.

Figure 23:
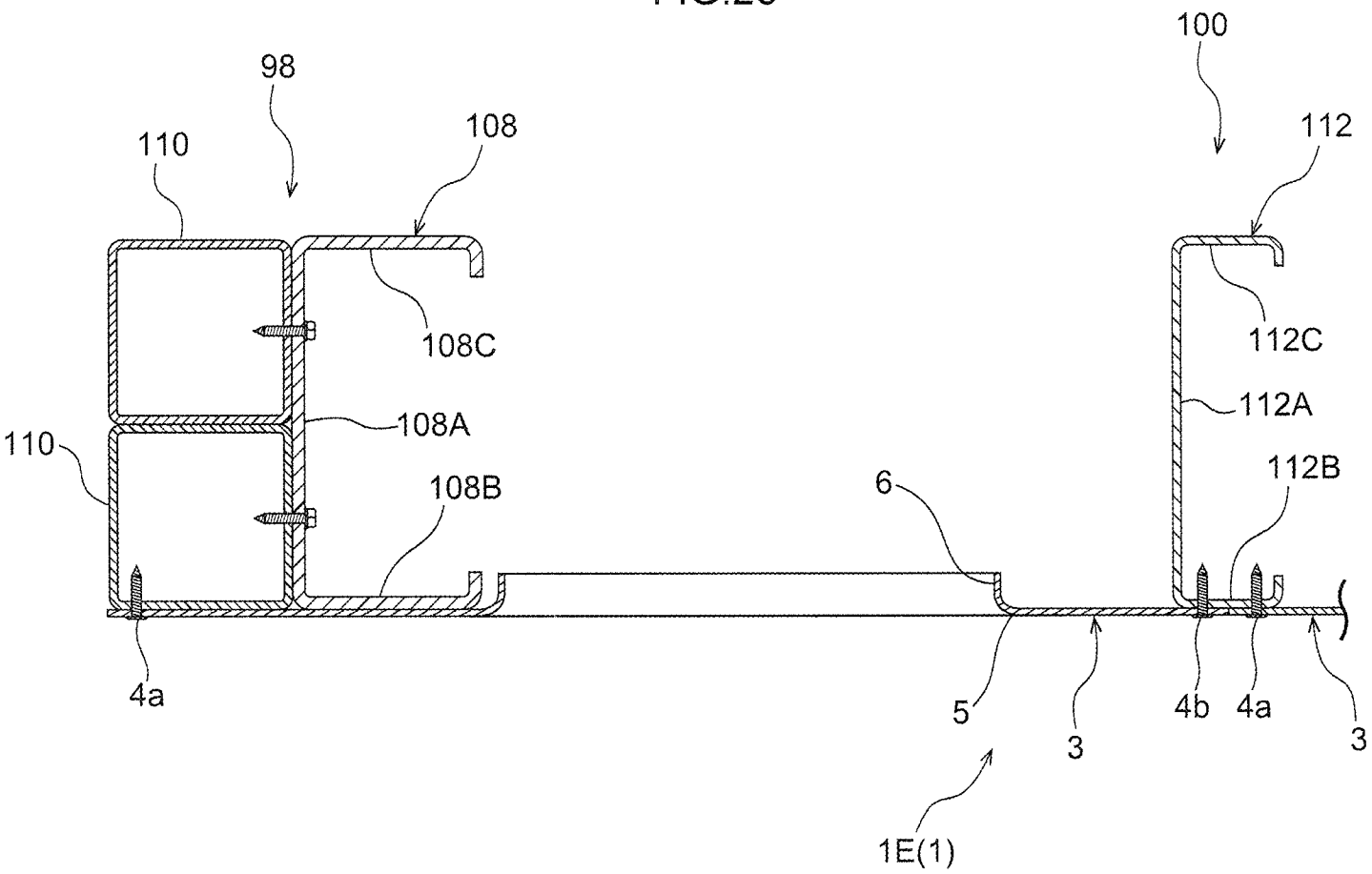
FIG. 23 is a cross-section illustrating a cross-section of a bearing wall sectioned along line 23-23 illustrated in FIG. 21.

As illustrated in FIG. 23, the first vertical member 98 is configured by a C-beam steel member 108 formed with a substantially C-shaped cross-section in plan view, open on the second vertical member 100 side, and two square-section steel members 110 formed with square cross-sections in plan view.

The C-beam steel member 108 includes a first wall section 108A, and a second wall section 108B and a third wall section 108C that respectively extend toward the second vertical member 100 side from the two ends of the first wall section 108A. Note that the leading end portions of the second wall section 108B and the leading end portions of the third wall section 108C configure rib portions that respectively bend around toward the third wall section 108C and the second wall section 108B side. The two square-section steel members 110 are fixed to the first wall section 108A of the C-beam steel member 108 in a state disposed along the first wall section 108A. In the present exemplary embodiment, the two square-section steel members 110 are fixed to the first wall section 108A using drill screws, however, the two square-section steel members 110 may be fixed to the first wall section 108A by another method, such a welding.

The second vertical member 100 is configured by a C-beam steel member 112 opening toward the opposite side to the first vertical member 98. The C-beam steel member 112 includes a first wall section 112A, a second wall section 112B, and a third wall section 112C, respectively corresponding to the first wall section 108A, the second wall section 108B, and the third wall section 108C of the C-beam steel member 108 configuring part of the first vertical member 98. In the present exemplary embodiment, the horizontal direction dimensions of the first wall section 108A of the C-beam steel member 108 and of the first wall section 112A of the C-beam steel member 112 are dimensions that are substantially the same dimensions as each other, and the horizontal direction dimensions of the second wall section 112B and the third wall section 112C of the C-beam steel member 112 are dimensions that are shorter than the horizontal direction dimensions of the second wall section 108B and the third wall section 108C of the C-beam steel member 108. The second vertical member 100 is disposed in plan view at the horizontal direction dimension center between the first vertical member 98 and the third vertical member 102.

The third vertical member 102 (not illustrated in FIG. 23) is configured similarly to the first vertical member 98 by fixing two square-section steel members 110 onto a C-beam steel member 108. The third vertical member 102 is disposed on the other side of the second vertical member 100 in plan view, and configured so as to be symmetrical to the first vertical member 98.

The upper frame 104 and the lower frame 106 are, as an example, configured by a square-section steel member having a rectangular cross-section, and the upper frame 104 and the lower frame 106 are respectively joined to the upper ends and lower ends of the first vertical member 98, the second vertical member 100, and the third vertical member 102 by fasteners, such as screws or bolts, by welding, or the like.

Figure 24:
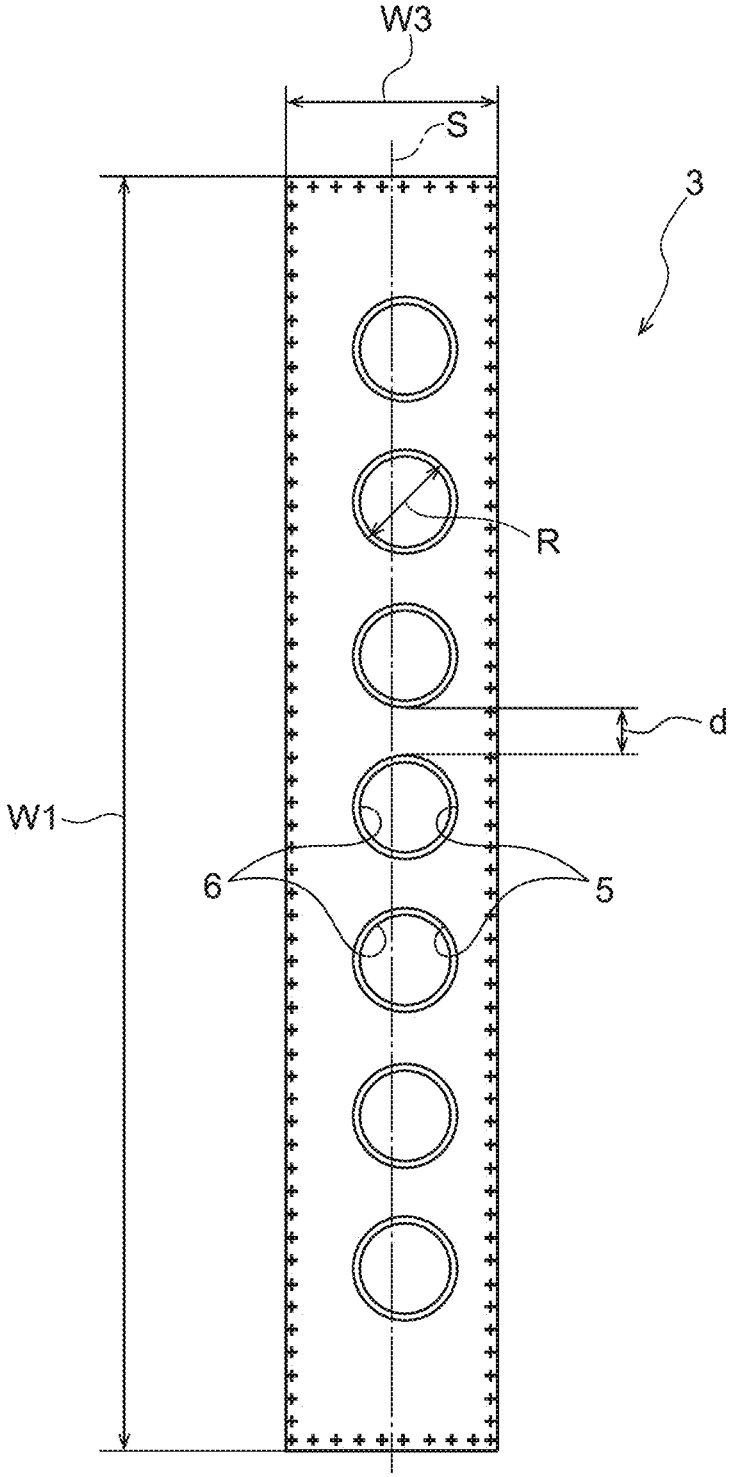
FIG. 24 is a side elevation illustrating a wall surface member of the bearing wall illustrated in FIG. 21.

As illustrated in FIG. 24, the wall surface member 3 is configured by performing press fabrication or the like on rectangular shaped steel sheet members, and forming seven circular shaped opening portions 5 in these wall surface members 3. More specifically, a dimension W1 of the wall surface member 3 in the up-down direction is a dimension that is substantially the same as a dimension W2 of the frame member 96 in the up-down direction (see FIG. 22), and the dimension W3 of the wall surface member 3 in the horizontal direction is a dimension that is approximately ½ that of a dimension W4 of the frame member 96 in the horizontal direction (see FIG. 22). The two wall surface members 3 are thereby fixed to the frame member 96 so as to be in an adjacent state to each other in the horizontal direction.

The two horizontal direction end portions of one of the wall surface members 3 are respectively fixed to the first vertical member 98 and the second vertical member 100, which are a pair of vertical members, using plural drill screws. The plural drill screws are disposed in the up-down direction at a specific pitch. The joint portions between the one wall surface member 3 and the first vertical member 98 (the portions where the drill screws are screwed in) are referred to as first joint portions 4*a*, and the joint portions between the one wall surface member 3 and the second vertical member 100 (the portions where the drill screws are screwed in) are referred to as second joint portions 4*b*. Moreover, the two up-down direction end portions of the one wall surface member 3 are respectively fixed to the upper frame 104 and the lower frame 106 using plural drill screws. The plural drill screws are disposed at a specific pitch in the horizontal direction. The joint portions between the one wall surface member 3 and the upper frame 104 (the portions where the drill screws are screwed in) are referred to as third joint portions 4*c*, and the joint portions between the one wall surface member 3 and the lower frame 106 (the portions where the drill screws are screwed in) are referred to as fourth joint portions 4*d*.

The two horizontal direction end portions of the other of the wall surface members 3 are respectively fixed to the second vertical member 100 and third vertical member 102, which are a pair of vertical members, using plural drill screws. The joint portions between the other wall surface member 3 and the second vertical member 100 (the portions where the drill screws are screwed in) are referred to as first joint portions 4*a*, and the joint portions between the other wall surface member 3 and the third vertical member 102 (the portions where the drill screws are screwed in) are referred to as second joint portions 4*b*. Moreover, the two up-down direction end portions of the other wall surface member 3 are respectively fixed to the upper frame 104 and the lower frame 106 using plural drill screws. The joint portions between the other wall surface member 3 and the upper frame 104 (the portions where the drill screws are screwed in) are referred to as third joint portions 4*c*, and the joint portions between the other wall surface member 3 and the lower frame 106 (the portions where the drill screws are screwed in) are referred to as fourth joint portions 4*d*.

Moreover, seven of the opening portions 5 were disposed in a single column at a specific spacing apart in the up-down direction, and these seven opening portions 5 were formed with substantially the same diameter R as each other, such that the distance d between adjacent opening portions 5, 5 was substantially the same dimension. The centers of the seven opening portions 5, 5 were offset toward the second vertical member 100 side (see FIG. 21) with respect to a horizontal direction center line S of the wall surface member 3. As illustrated in FIG. 21 a distance D1 between axial centers 5*b*, 5*b* of adjacent opening portions 5, 5 in the up-down direction is set so as to be smaller than a horizontal separation distance D2 between the first joint portions 4*a* and the second joint portions 4*b*. Moreover, an up-down separation distance U1 between the uppermost formed opening portion 5 and the third joint portions 4*c* is set so as to be longer than the distance d between adjacent opening portions 5, 5, and an up-down separation distance U2 between the lowermost formed opening portion 5 and the fourth joint portions 4*d* is set so as to be longer than the distance d between adjacent opening portions 5, 5.

Ring-shaped ribs 6 similar to those of the bearing wall 1 in the first exemplary embodiment (see FIG. 1B) are formed to the edge portions of the opening portions 5.

The first vertical member 98 disposed at one side in the horizontal direction of the first story section 82, the upper frame 104, and the lower frame 106 (see FIG. 21) are respectively fixed to the vertical member 94, the upper member 92, and the lower frame 90 using non-illustrated fastening members (for example bolts and nuts). The third vertical member 102 disposed at the other horizontal direction side in the first story section 82, the upper frame 104, and the lower frame 106 (see FIG. 21) are also fixed to the vertical member 94, the upper member 92, and the lower frame 90 using non-illustrated fastening members. The bearing wall 1 disposed at the second story portion is also fixed to the upper member 92 and the vertical members 94 similarly to the bearing wall 1 provided in the first story section 82.

In the bearing wall 1 of the present exemplary embodiment explained above, when earthquake load is input to the building 80, the horizontal force on the third story and higher accompanying the earthquake is input to the bearing wall 1 of the second story section 84, and shear stress occurs in the bearing wall 1 of the second story section 84. The shear stress in the bearing wall 1 of the second story section 84, and the horizontal force of the second story section 84, are input to the bearing wall 1 of the first story section 82, and shear stress occurs in the bearing wall 1 of the first story section 82. The shear stress in the bearing wall 1 of first story section 82 is transmitted to the ground surface 86 through the foundation 88. When this occurs, an axial force is generated in the vertical direction on the vertical members 94 on each story, and the axial force of the vertical members 94 on each story is transmitted in the up-down direction through fittings 114.

When the earthquake load is transmitted to the bearing wall 1 here, the value of the shear stress (von Mises stress) at horizontal direction intermediate portions of the wall surface member 3 between the first joint portions 4*a* and the opening portions 5, and the shear stress values at horizontal direction intermediate portions of the wall surface member 3 between the second joint portions 4*b* and the opening portions 5, can be made lower than the shear stress values at up-down direction intermediate portions of the wall surface member 3 between one opening portion 5 and another opening portion 5 of adjacent opening portions in the up-down direction. This thereby enables the shear stress occurring in the horizontal direction in a pair of vertical members (the first vertical member 98 and the second vertical member 100, or the second vertical member 100 and the third vertical member 102) to be reduced. As a result, deformation at the join portions between the wall surface member 3 and the pair of vertical members can be suppressed prior to deformation of the up-down direction intermediate portions of the wall surface member 3 between one opening portion 5 and another opening portion 5 of adjacent opening portions in the up-down direction, enabling earthquake energy to be stabilized and absorbed.

In the present exemplary embodiment, due to configuring the bearing wall 1 by fixing the two the wall surface members 3 to the single frame member 96, a more rigid bearing wall 1 can be obtained than the bearing wall 1 in the first exemplary embodiment (see FIG. 1A).

Figure 25:
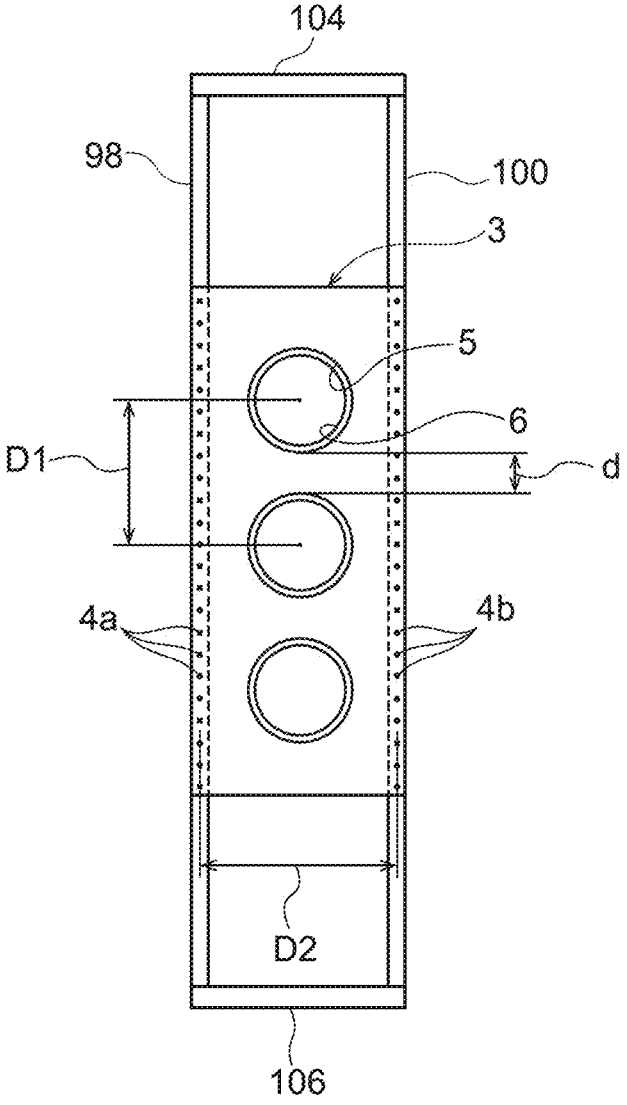
FIG. 25 is a side elevation illustrating a bearing wall according to a modified example.

Although explanation has been given in the present exemplary embodiment of an example in which the two up-down direction end portions of the wall surface member 3 are respectively fixed to the upper frame 104 and the lower frame 106, the present invention is not limited thereto. For example, as illustrated in FIG. 25, configuration may be made such that the two up-down direction end portions of the wall surface member 3 are separated from the upper frame 104 and the lower frame 106. Note that the same reference numerals are appended to each portion of the bearing wall illustrated in FIG. 25 to those applied to corresponding portions of the fifth exemplary embodiment.

Explanation has been given in the first exemplary embodiment to the fifth exemplary embodiment described above of examples in which the ring-shaped ribs 6 are provided to the edge portions of the opening portions 5; however, the present invention is not limited thereto, and a configuration may, for example, be adopted in which the ring-shaped ribs 6 are not provided thereto.

Moreover, although explanation has been given in the first exemplary embodiment to the fifth exemplary embodiment described above of examples in which distances d between adjacent opening portions 5, 5 are set to substantially the same dimension, the present invention is not limited thereto. For example, the separation distance between one adjacent pair of the opening portions 5, 5 may be made different from the separation distance between another pair of the opening portions 5, 5.

In the above, explanation has been given of the present invention employing the exemplary embodiments of the bearing walls 1A to 1E; however, the bearing wall and the wall surface member for a bearing wall according to the present invention are not limited to the exemplary embodiments described above, and obviously various modifications may be made and implemented other than those described above.

The disclosure of Japanese Patent Application No. 2013-186511 filed on Sep. 9, 2013 is incorporated in its entirety by reference in the present specification.

The invention claimed is:

1. A bearing wall comprising: a pair of vertical members made from steel that are joined to upper and lower horizontal members of a building so as to be spaced apart in a horizontal direction; and a wall surface member that is made from steel, that includes a first joint portion joined to one of the vertical members, that includes a second joint portion joined to another of the vertical members, and that includes circular-shaped opening portions that are spaced apart in an up-down direction between the pair of vertical members so as to be disposed in only one column, wherein a separation distance between a center of one opening portion and a center of an opening portion that is adjacent to the one opening portion in the up-down direction is shorter than a horizontal separation distance between the first joint portion and the second joint portion, and a circular ring-shaped rib is formed at an edge portion of each of the opening portions so as to project out, toward a direction that is out of plane with the wall surface member, with respect to a general portion that is a flat portion of the wall surface member not formed with the opening portions, and wherein: one or more of structural features (i), (ii), (iii), or (iv), said features being (i) a profile of the ring-shaped ribs, (ii) a height of the ring-shaped ribs relative to the general portion, (iii) an internal diameter of the opening portions, and (iv) the separation distance between the center of the one opening portion and the center of the opening portion that is adjacent to the one opening portion in the up-down direction, is configured to provide a maximum von Mises stress occurring at the ring-shaped ribs that is lower than the maximum von Mises stress occurring at locations on the wall surface member between opening portions which are adjacent to each other in the up-down direction.

2. The bearing wall of claim 1, wherein an internal diameter of the ring-shaped ribs gradually decreases on progression in the direction that is out of plane with the wall surface member.

3. The bearing wall of claim 1, wherein:

an internal diameter at locations of the ring-shaped ribs on a general portion side gradually decreases on progression toward the direction that is out of plane with the wall surface member; and a location of the ring-shaped ribs on the side away from a general portion is formed in a circular tube shape.

4. The bearing wall of claim 1, wherein:

a height of the ring-shaped ribs with respect to the general portion, at a position offset by 45° in a circumferential direction of each opening portion with respect to a bisecting line that bisects the opening portion in a horizontal direction or a bisecting line that bisects the opening portion in the up-down direction, is greater than a height of the ring-shaped ribs with respect to the general portion on the bisecting line.

5. A wall surface member for a bearing wall, wherein the wall surface member is made from steel and comprises: a first joint portion configured to join to one vertical member made from steel; a second joint portion configured to join to another vertical member made from steel and having a fixed spacing from the first joint portion; and circular shaped opening portions that are disposed so as to be spaced apart from each other in only one column along the first joint portion and the second joint portion, between the first joint portion and the second joint portion, wherein a separation distance between a center of one opening portion and a center of an opening portion that is adjacent to the one opening portion in the up-down direction is shorter than a separation distance between the first joint portion and the second joint portion, and a circular ring-shaped rib is formed at an edge portion of each of the opening portions so as to project out, toward a direction that is out of plane with a general portion that is a flat portion of the wall surface member not formed with the opening portions, and wherein: one or more of structural features (i), (ii), (iii), or (iv), said features being (i) a profile of the ring-shaped ribs, (ii) a height of the ring-shaped ribs relative to the general portion, (iii) an internal diameter of the opening portions, and (iv) the separation distance between the center of the one opening portion and the center of the opening portion that is adjacent to the one opening portion in the up-down direction, is configured to provide a maximum von Mises stress occurring at the ring-shaped ribs that is lower than the maximum von Mises stress occurring at locations on the wall surface member between opening portions which are adjacent to each other in the up-down direction.

* * * * *